US007654919B2

(12) United States Patent
Sajima

(10) Patent No.: US 7,654,919 B2
(45) **Date of Patent: *Feb. 2, 2010**

(54) GOLF BALL

(75) Inventor: Takahiro Sajima, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/802,876

(22) Filed: May 25, 2007

(65) Prior Publication Data

US 2007/0298908 A1 Dec. 27, 2007

(30) Foreign Application Priority Data

Jun. 23, 2006 (JP) ..... 2006-173319

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS

| | | | | |
|---|---|---|---|---|
| 4,729,861 | A | 3/1988 | Lynch et al. | |
| 4,813,677 | A | 3/1989 | Oka et al. | |
| 4,936,587 | A | 6/1990 | Lynch et al. | |
| 5,080,367 | A | 1/1992 | Lynch et al. | |
| 5,292,132 | A | 3/1994 | Oka | |
| 7,195,570 | B2 * | 3/2007 | Hanada et al. | 473/383 |
| 2005/0137032 | A1 * | 6/2005 | Aoyama et al. | 473/378 |

FOREIGN PATENT DOCUMENTS

| | | | |
|---|---|---|---|
| JP | 62-192181 | A | 8/1987 |
| JP | 4-347177 | A | 12/1992 |
| JP | 5-8630 | A | 1/1993 |
| JP | 2000-325499 | A | 11/2000 |

* cited by examiner

*Primary Examiner*—Raeann Trimiew
(74) *Attorney, Agent, or Firm*—Birch, Stewart, Kolasch & Birch, LLP

(57) ABSTRACT

Golf ball 2 has numerous dimples 8. Provided that mean diameter of all the dimples 8 is Da, ratio (N1/N) of number N1 of adjacent dimple pairs having a pitch of (Da/4) or less to total number N of the dimples is equal to or greater than 2.70. Ratio (N2/N1) of number N2 of the adjacent dimple pairs having a pitch of (Da/20) or less to the number N1 is equal to or greater than 0.50. The northern hemisphere N and the southern hemisphere S of this golf ball 2 have a pole vicinity region 20, an equator vicinity region 22 and a coordination region 24, respectively. The pole vicinity region 20 includes 5 units which are rotationally symmetric each other centered on the pole point P. The equator vicinity region 22 includes 6 units which are rotationally symmetric each other centered on the pole point P. The coordination region 24 does not include any unit.

12 Claims, 16 Drawing Sheets

48
52
U
54
U
52
52
A
A
A

GOLF BALL

This application claims priority on Patent Application No. 2006-173319 filed in JAPAN on Jun. 23, 2006. The entire contents of this Japanese Patent Application are hereby incorporated by reference.

BACKGROUND OF THE INVENTION

1. Field of the Invention

The present invention relates to golf balls. More particularly, the present invention relates to improvement of dimples of golf balls.

2. Description of the Related Art

Golf balls have numerous dimples on the surface thereof. The dimples disrupt the air flow around the golf ball during flight to cause turbulent flow separation. By causing the turbulent flow separation, separating points of the air from the golf ball shift backwards leading to the reduction of drag. The turbulent flow separation prolongs the gap between the separating point on the upper side and the separating point on the lower side of the golf ball, which results from the backspin, thereby the lift force that acts upon the golf ball is enhanced. Reduction in drag and elevation of lift force are referred to as "dimple effect". Excellent dimples disturb the air flow more efficiently. Owing to the excellent dimples, great flight distance can be achieved.

It is known to persons skilled in the art that a great dimple effect is achieved according to golf balls having the dimples densely arranged. Some proposals have been made in connection with dimple pattern aiming at improvement of the dimple effect.

JP-A-S50-8630 (U.S. Pat. Nos. 4,729,861, 4,936,587 and 5,080,367) discloses a golf ball provided with numerous dimples having a uniform size. In this golf ball, pitch is smaller than 0.065 inch for most of the dimple pairs. According to this golf ball, relationship between the pitch and dimple diameter was not considered. In comparison with general dimple diameter, the pitch of 0.065 inch is not small enough. According to the pattern of the dimples having a uniform size, the diameter can not be set to be great. The dimples in this golf ball are not arranged densely enough.

JP-A-S62-192181 (U.S. Pat. No. 4,813,677) discloses a golf ball provided with large dimples and small dimples. In this golf ball, high dimple density is achieved by arranging small dimples in the region surrounded by multiple large dimples. However, the small dimples are not sufficiently responsible for the dimple effect.

JP-A-H4-347177 (U.S. Pat. No. 5,292,132) discloses a golf ball having the dimples arranged so that any rectangle having a predetermined size can not be formed on the land. In this golf ball, small proportion of the land is achieved by arranging many small dimples. However, the small dimples are not sufficiently responsible for the dimple effect.

Top concern to golf players for golf balls is their flight distance. In light of flight performance, there is room for improvement of the dimple pattern. An object of the present invention is to provide a golf ball that is excellent in the flight performance.

SUMMARY OF THE INVENTION

The golf ball according to the present invention has numerous dimples on the surface thereof. Provided that mean diameter of all the dimples is Da, ratio (N1/N) of number N1 of adjacent dimple pairs having a pitch of (Da/4) or less to total number N of the dimples is equal to or greater than 2.70. Ratio (N2/N1) of number N2 of the adjacent dimple pairs having a pitch of (Da/20) or less to the number N1 is equal to or greater than 0.50.

Preferably, the ratio (N2/N1) is equal to or greater than 0.60. Preferably, the mean diameter Da is equal to or greater than 4.00 mm. Preferably, total number N of the dimples is equal to or less than 362. Preferably, proportion of total area of all the dimples to surface area of a phantom sphere of the golf ball is equal to or greater than 75%.

In the golf ball according to the present invention, the pitch is small enough in comparison with the mean diameter Da. In this golf ball, the dimples are densely arranged, and individual dimples can be responsible for the dimple effect. This golf ball is excellent in the flight performance.

Preferably, the northern hemisphere and the southern hemisphere of the surface of this golf ball have a pole vicinity region, an equator vicinity region and a coordination region, respectively. This coordination region is located between the pole vicinity region and the equator vicinity region. The dimple pattern in the pole vicinity region includes multiple units. These units are rotationally symmetric each other centered on the pole point. The dimple pattern in the equator vicinity region includes multiple units. These units are rotationally symmetric each other centered on the pole point. Number of the units in the pole vicinity region is different from number of the units in the equator vicinity region. The dimple pattern in the coordination region is either a pattern which cannot be comparted into multiple units that are rotationally symmetric each other centered on the pole point, or a pattern including multiple units that are rotationally symmetric each other centered on the pole point with number of the units being different from the numbers of the units in the pole vicinity region and the equator vicinity region.

It is preferred that any great circle that does not cross the dimple is not present on the surface of this golf ball.

DESCRIPTION OF THE PREFERRED EMBODIMENTS

Hereinafter, the present invention will be described in detail according to the preferred embodiments with appropriate references to the accompanying drawing.

Figure 1:
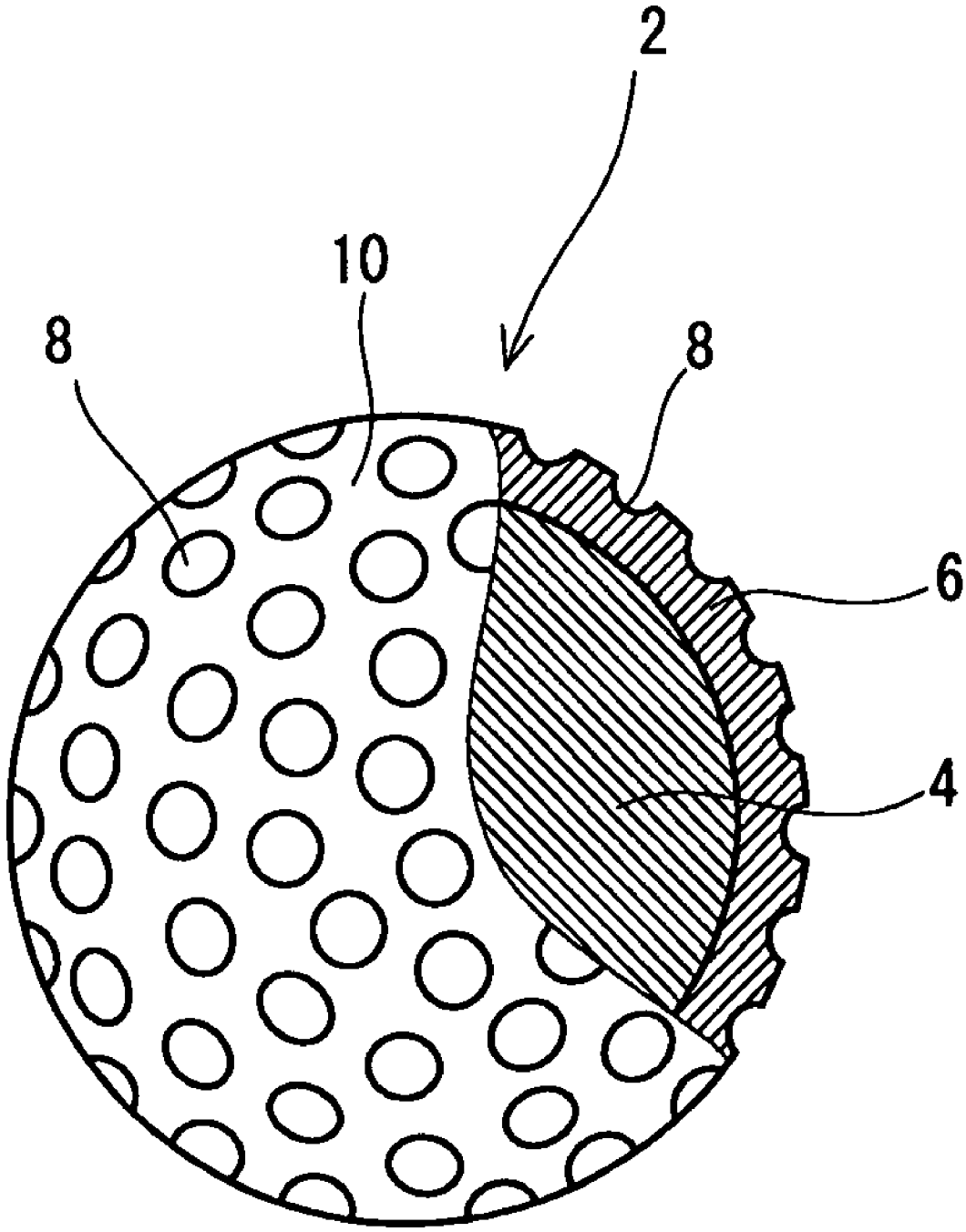
FIG. 1 shows a schematic cross-sectional view illustrating a golf ball according to one embodiment of the present invention.

Golf ball 2 shown in FIG. 1 has a spherical core 4 and a cover 6. Numerous dimples 8 are formed on the surface of the cover 6. Of the surface of the golf ball 2, a part except for the dimples 8 is a land 10. This golf ball 2 has a paint layer and a mark layer to the external side of the cover 6, although these layers are not shown in the Figure. A mid layer may be provided between the core 4 and the cover 6.

This golf ball 2 has a diameter of 40 mm or greater and 45 mm or less. From the standpoint of conformity to a rule defined by United States Golf Association (USGA), the diameter is more preferably equal to or greater than 42.67 mm. In light of suppression of the air resistance, the diameter is more preferably equal to or less than 44 mm, and particularly preferably equal to or less than 42.80 mm. Weight of this golf ball 2 is 40 g or greater and 50 g or less. In light of attainment of great inertia, the weight is more preferably equal to or greater than 44 g, and particularly preferably equal to or greater than 45.00 g. From the standpoint of conformity to a rule defined by USGA, the weight is more preferably equal to or less than 45.93 g.

The core 4 is formed by crosslinking a rubber composition. Illustrative examples of the base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred, and high cis-polybutadienes are particularly preferred.

For crosslinking of the core 4, a co-crosslinking agent is suitably used. Examples of the co-crosslinking agent that is preferable in light of the resilience performance include zinc acrylate, magnesium acrylate, zinc methacrylate and magnesium methacrylate. Into the rubber composition, an organic peroxide may be preferably blended together with the co-crosslinking agent. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide.

Various kinds of additives such as a sulfur compound, a filler, an anti-aging agent, a coloring agent, a plasticizer, a dispersant and the like may be blended in an adequate amount into the rubber composition of the core 4 as needed. Into the rubber composition may be also blended crosslinked rubber powder or synthetic resin powder.

The core 4 has a diameter of equal to or greater than 30.0 mm, and particularly equal to or greater than 38.0 mm. The core 4 has a diameter of equal to or less than 42.0 mm, and particularly equal to or less than 41.5 mm. The core 4 may be composed of two or more layers.

Polymer which may be suitably used in the cover 6 is an ionomer resin. Examples of preferred ionomer resin include binary copolymers formed with α-olefin and an α,β-unsaturated carboxylic acid having 3 or more and 8 or less carbon atoms. Examples of other preferred ionomer resin include ternary copolymers formed with α-olefin, an α,β-unsaturated carboxylic acid having 3 or more and 8 or less carbon atoms, and an α,β-unsaturated carboxylate ester having 2 or more and 22 or less carbon atoms. In the binary copolymer and ternary copolymer, preferable α-olefin is ethylene and propylene, and preferable α,β-unsaturated carboxylic acid is acrylic acid and methacrylic acid. In the binary copolymer and ternary copolymer, a part of the carboxyl group is neutralized with a metal ion. Illustrative examples of the metal ion for use in neutralization include sodium ion, potassium ion, lithium ion, zinc ion, calcium ion, magnesium ion, aluminum ion and neodymium ion.

Other polymer may be used in place of or together with the ionomer resin. Illustrative examples of the other polymer include thermoplastic styrene elastomers, thermoplastic polyurethane elastomers, thermoplastic polyamide elastomers, thermoplastic polyester elastomers and thermoplastic polyolefin elastomers.

Into the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 6 may be also blended with powder of a highly dense metal such as tungsten, molybdenum or the like for the purpose of adjusting the specific gravity.

The cover 6 has a thickness of equal to or greater than 0.3 mm, and particularly equal to or greater than 0.5 mm. The cover 6 has a thickness of equal to or less than 2.5 mm, and particularly equal to or less than 2.2 mm. The cover 6 has a specific gravity of equal to or greater than 0.90, and particularly equal to or greater than 0.95. The cover 6 has a specific gravity of equal to or less than 1.10, and particularly equal to or less than 1.05. The cover 6 may be composed of two or more layers.

Figure 2:
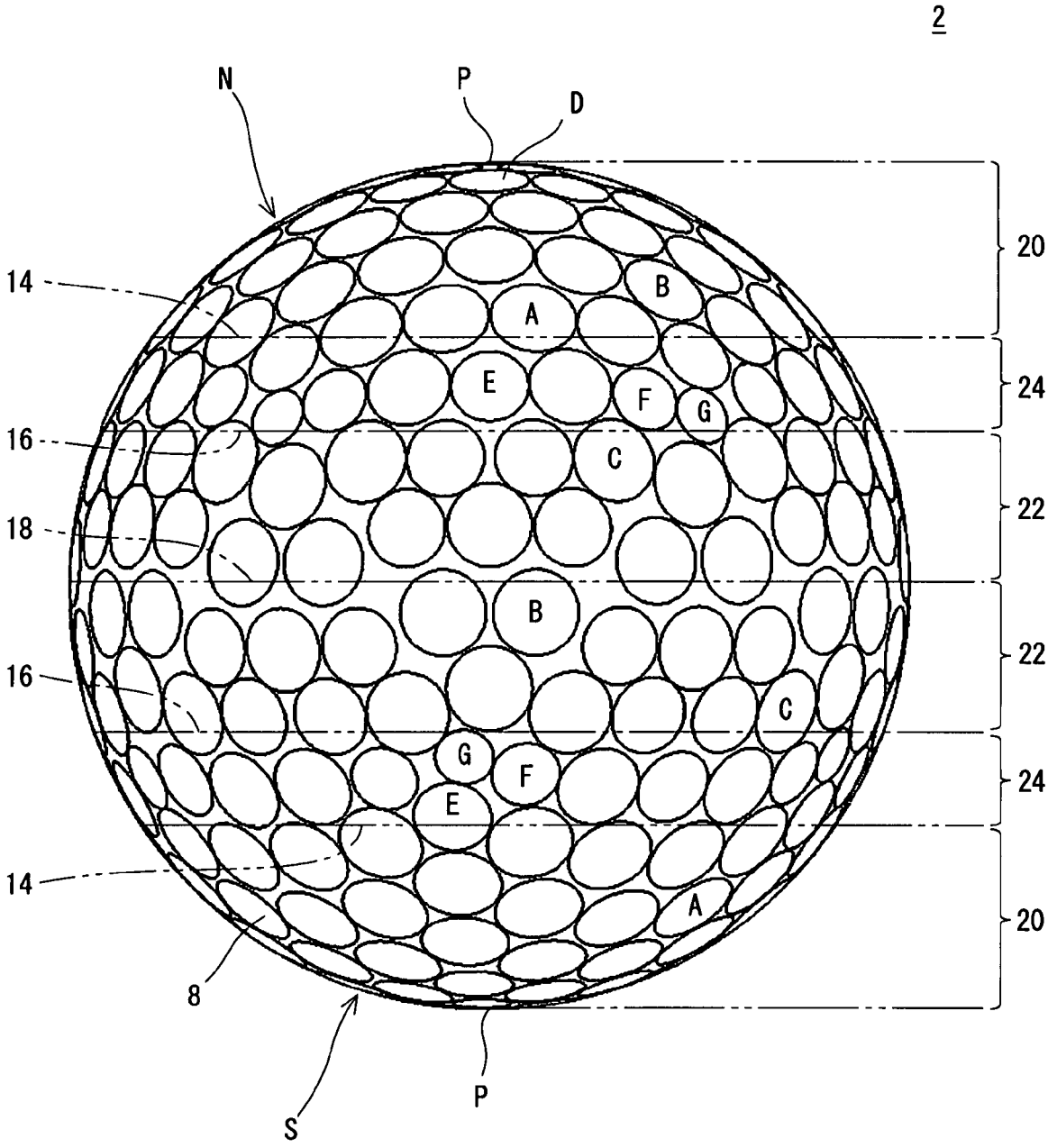
FIG. 2 shows an enlarged front view illustrating the golf ball shown in FIG. 1.

FIG. 2 shows an enlarged front view illustrating the golf ball 2 shown in FIG. 1. In FIG. 2, types of the dimples 8 are indicated by the reference signs A to G. All dimples 8 have a plane shape of circular. This golf ball 2 has dimples A having a diameter of 4.5 mm, dimples B having a diameter of 4.4 mm, dimples C having a diameter of 4.3 mm, dimples D having a diameter of 4.1 mm, dimples E having a diameter of 4.0 mm, dimples F having a diameter of 3.5 mm, and dimples G having a diameter of 3.0 mm. Number of the dimples A is 60; number of the dimples B is 86; number of the dimples C is 56; number of the dimples D is 10; number of the dimples E is 76; number of the dimples F is 22; and number of the dimples G is 18. Total number of the dimples 8 is 328. Mean diameter Da is 4.16 mm.

Figure 3:
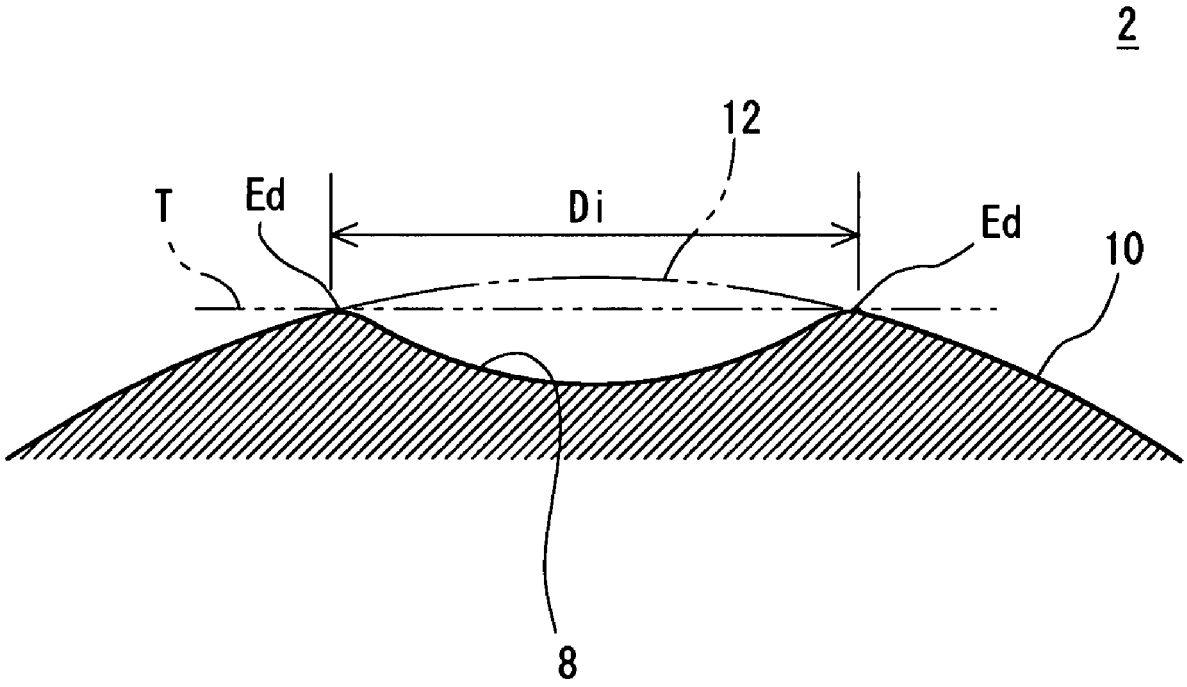
FIG. 3 shows an enlarged cross-sectional view illustrating a part of the golf ball shown in FIG. 1.

FIG. 3 shows an enlarged cross-sectional view illustrating a part of the golf ball 2 shown in FIG. 1. In this FIG. 3, a cross section along a plane passing through the center (deepest part) of the dimple 8 and the center of the golf ball 2 is shown. A top-to-bottom direction in FIG. 3 is an in-depth direction of the dimple 8. What is indicated by a chain double-dashed line 12 in FIG. 3 is a phantom sphere. The phantom sphere 12 corresponds to the surface of the golf ball 2 when it is postulated that there is no dimple 8 existed. The dimple 8 is recessed from the phantom sphere 12. The land 10 agrees with the phantom sphere 12.

In FIG. 3, what is indicated by a both-oriented arrowhead Di is the diameter of the dimple 8. This diameter Di is a distance between one contact point Ed and another contact point Ed, which are provided when a tangent line T that is common to both sides of the dimple 8 is depicted. The contact point Ed is also an edge of the dimple 8. The edge Ed defines the contour of the dimple 8. The diameter Di is preferably 2.00 mm or greater and 6.00 mm or less. By setting the diameter Di to be equal to or greater than 2.00 mm, great dimple effect can be achieved. In this respect, the diameter Di is more preferably equal to or greater than 2.20 mm, and particularly preferably equal to or greater than 2.40 mm. By setting the diameter Di to be equal to or less than 6.00 mm, fundamental feature of the golf ball 2 which is substantially a sphere can be maintained. In this respect, the diameter Di is more preferably equal to or less than 5.80 mm, and particularly preferably equal to or less than 5.60 mm.

Figure 4:
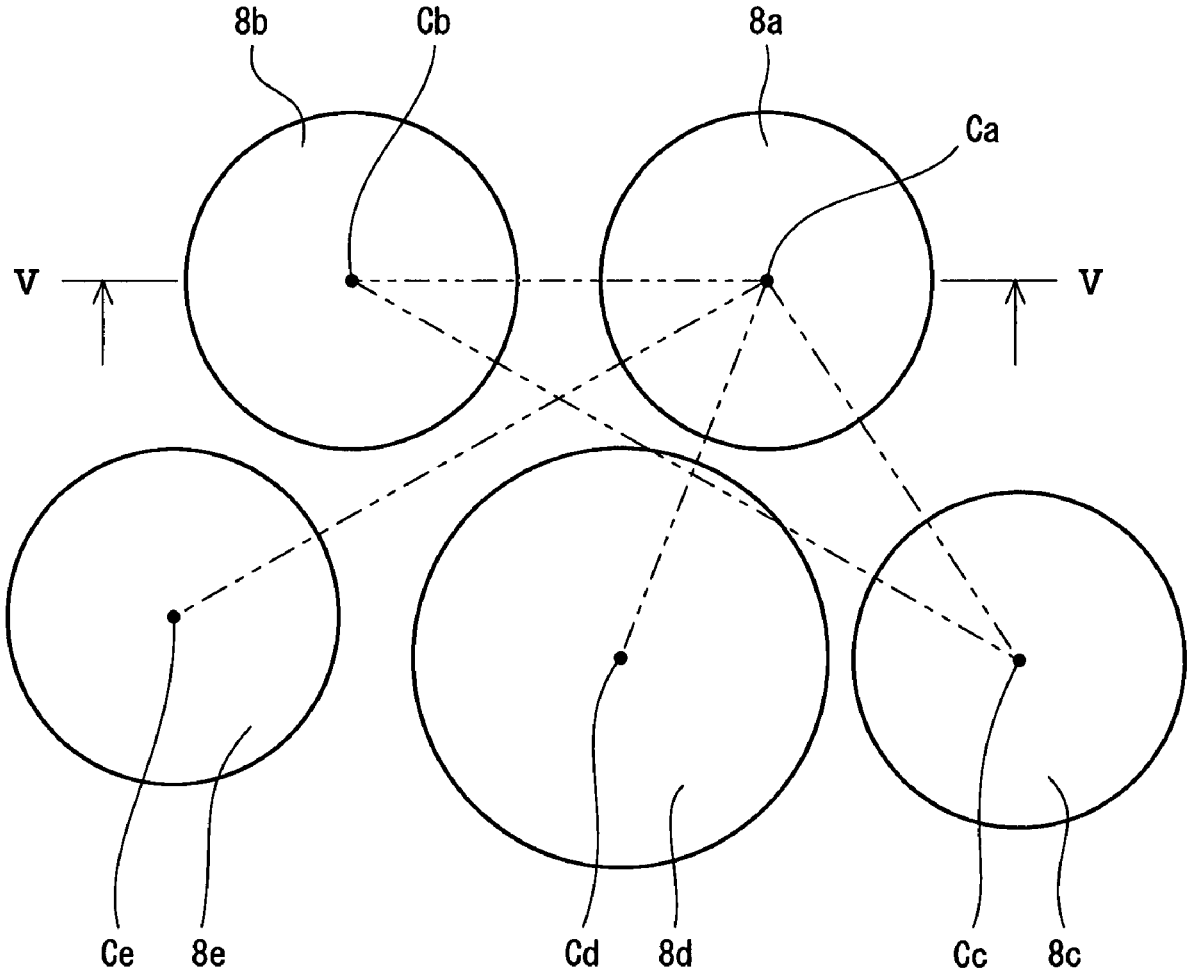
FIG. 4 shows an enlarged front view illustrating a part of the golf ball shown in FIG. 2.

FIG. 4 shows an enlarged front view illustrating a part of the golf ball 2 shown in FIG. 2. In this FIG. 4, dimple 8*a*, dimple 8*b*, dimple 8*c*, dimple 8*d* and dimple 8*e* are illustrated. A plane along a line V-V in FIG. 4 passes through the center of the dimple 8*a* and the center of the dimple 8*b*.

Figure 5:
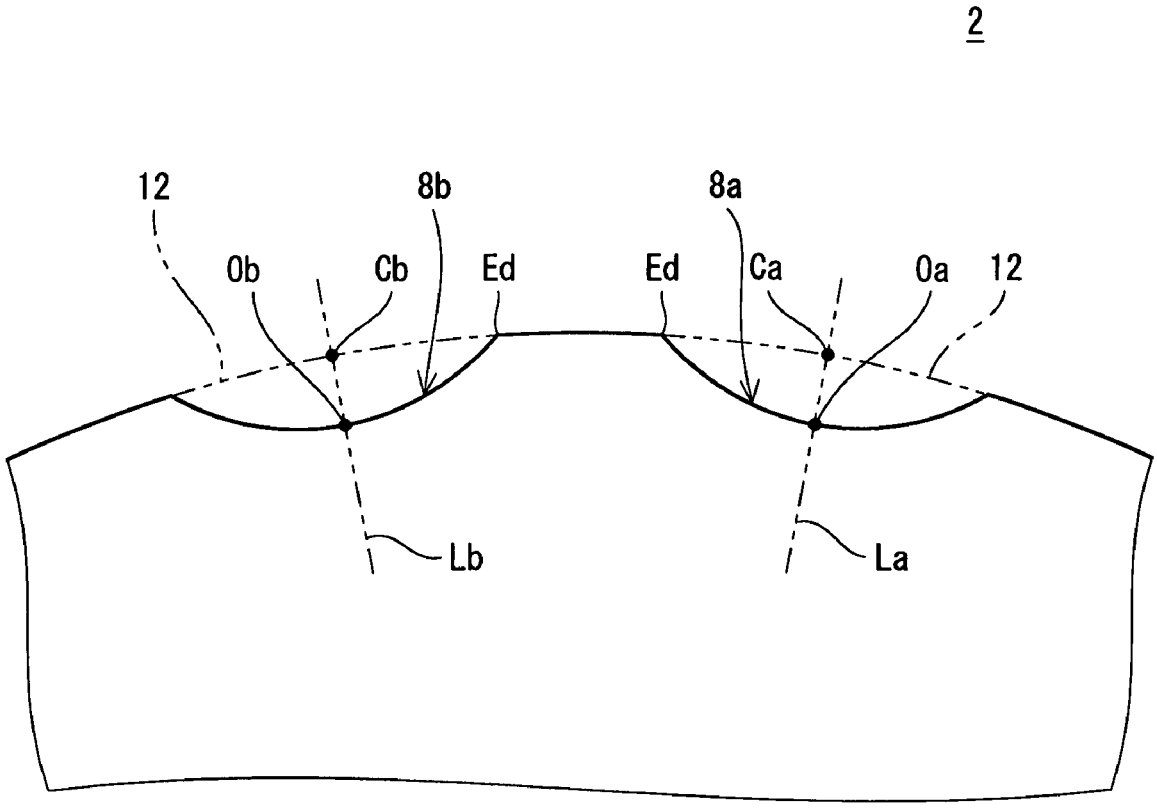
FIG. 5 shows a cross-sectional view taken along a line V-V of FIG. 4.

FIG. 5 shows a cross-sectional view taken along a line V-V of FIG. 4. In FIG. 5, what is indicated by reference sign Oa is the center of the dimple 8*a*, and what is indicated by reference sign Ob is the center of the dimple 8*b*. What is indicated by reference sign Ca is an intersecting point of line La passing the center Oa and extending in a radial direction of the golf ball 2 with the phantom sphere 12. What is indicated by reference sign Cb is an intersecting point of line Lb passing the center Ob and extending in a radial direction of the golf ball 2 with the phantom sphere 12. The circular arc provided by connecting the point Ca and the point Cb is referred to as "joint arc". The joint arc is present on the surface of the phantom sphere 12. The joint arc is a part of the great circle. The joint arc does not cross other dimple 8. Herein, a dimple pair the joint arc of which does not cross other dimple 8 is referred to as "adjacent dimple pair". The dimple 8*a* and the dimple 8*b* construct the adjacent dimple pair. The edge Ed of the dimple 8*a* is positioned on the joint arc (Ca-Cb). Also the edge Ed of the dimple 8*b* is positioned on the joint arc (Ca-Cb). The circular arc (Ed-Ed) is a part of the joint arc (Ca-Cb). The length of the circular arc (Ed-Ed) corresponds to the pitch of the adjacent dimple pair (8*a*-8*b*). When the dimple 8*a* is away from the dimple 8*b*, the value of the pitch is positive. When the dimple 8*a* is in contact with the dimple 8*b*, the value of the pitch is zero. When the dimple 8*a* crosses the dimple 8*b*, the value of the pitch is zero.

As is clear from FIG. 4, the joint arc (Ca-Cc) does not cross other dimple 8. The dimple 8*a* and the dimple 8*c* construct the adjacent dimple pair. The joint arc (Ca-Cd) does not cross other dimple 8. The dimple 8*a* and the dimple 8*d* construct the adjacent dimple pair. The joint arc (Ca-Ce) does not cross other dimple 8. The dimple 8*a* and the dimple 8*e* construct the adjacent dimple pair. The joint arc (Cb-Cc) crosses the dimple 8*d*. Thus, pair of the dimple 8*b* and the dimple 8*c* is not the adjacent dimple pair.

This golf ball 2 has 1382 adjacent dimple pairs. Among them, 914 adjacent dimple pairs have a pitch of equal to or less than (Da/4), and 546 adjacent dimple pairs have a pitch of equal to or less than (Da/20). The pitch of equal to or less than (Da/20) is extremely small in comparison with the mean diameter Da. In this golf ball 2, the ratio (N1/N) of the number N1 of the adjacent dimple pairs having a pitch of (Da/4) or less to the total number N of the dimples is 2.79. In this golf ball 2, the ratio (N2/N1) of the number N2 of the adjacent dimple pairs having a pitch of (Da/20) or less to the number N1 is 0.60.

The ratio (N1/N) is preferably equal to or greater than 2.70, and the ratio (N2/N1) is preferably equal to or greater than 0.50. In other words, it is preferred that the golf ball 2 satisfies the following formulae (I) and (II):

$$(N1/N) \geqq 2.70 \quad \text{(I)},$$

$$(N2/N1) \geqq 0.50 \quad \text{(II)}.$$

In the present invention, when the numbers N1 and N2 are calculated, the pitch is compared with the mean diameter Da. According to conventional golf balls having numerous small dimples arranged in order to achieve high density, the values of (N1/N) and (N2/N1) are small. To the contrary, in the golf ball 2 which satisfies the above formulae (I) and (II), the dimples 8 are arranged in an extremely dense manner, and the number of small dimples 8 is low. In this golf ball 2, individual dimples 8 can be responsible for the dimple effect. This golf ball 2 is excellent in the flight performance.

In light of the flight performance, the ratio (N1/N) is preferably equal to or greater than 2.75, and particularly preferably equal to or greater than 2.90. The ratio (N1/N) is preferably equal to or less than 4.00. In light of the flight performance, the ratio (N2/N1) is more preferably equal to or greater than 0.54, still more preferably equal to or greater than 0.60, and particularly preferably equal to or greater than 0.64. The ratio (N2/N1) is equal to or less than 1.00.

In light of achievement of the dimple effect of the individual dimples 8, the mean diameter Da is preferably equal to or greater than 4.00 mm, more preferably equal to or greater than 4.10 mm, and particularly preferably equal to or greater than 4.15 mm. The mean diameter Da is preferably equal to or less than 5.50 mm. By setting the mean diameter Da to be equal to or less than 5.50 mm, fundamental feature of the golf ball 2 which is substantially a sphere can be maintained.

Area s of the dimple 8 is an area of a region surrounded by the contour line when the center of the golf ball 2 is viewed at infinity. In instances of a circular dimple 8, the area s is calculated by the following formula:

$$s=(Di/2)^2\cdot\pi$$

In the golf ball 2 shown in FIG. 2, the area of the dimple A is 15.90 $mm^2$; the area of the dimple B is 15.20 $mm^2$; the area of the dimple C is 14.52 $mm^2$; the area of the dimple D is 13.20 $mm^2$; the area of the dimple E is 12.57 $mm^2$; the area of the dimple F is 9.62 $mm^2$; and the area of the dimple G is 7.07 $mm^2$.

In the present invention, ratio of total of the areas s of all the dimples 8 to the surface area of the phantom sphere 12 is referred to as an occupation ratio. From the standpoint that sufficient dimple effect is achieved, the occupation ratio is preferably equal to or greater than 75%, more preferably equal to or greater than 78%, and particularly preferably equal to or greater than 81%. The occupation ratio is preferably equal to or less than 90%. According to the golf ball 2 shown in FIG. 2, total area of the dimples 8 is 4500.5 $mm^2$. Because the surface area of the phantom sphere 12 of this golf ball 2 is 5728.0 $mm^2$, the occupation ratio is 78.6%.

When the diameter Di of the dimple 8 is set to be great, the dimples 8 may cross with each other. Although apparent occupation ratio of the dimples 8 is great in the golf ball 2 having numerous crossings, the effective area of the dimples 8 shall be small. In light of the flight performance, greater effective area is more preferred as compared with the apparent occupation ratio. In other words, it is preferred that number of the crossings of the dimples 8 is smaller. Ratio (N3/N1) of number N3 of crossing adjacent dimple pairs to the number N1 is preferably equal to or less than 0.10, more preferably equal to or less than 0.08, and particularly preferably equal to or less than 0.06. Ideally, the ratio (N3/N1) is zero. In the golf ball 2 shown in FIG. 2, the number N3 is 12, and the ratio (N3/N1) is 0.013.

In light of the dimple effect, ratio (N4/N) of number N4 of the dimples 8 having a diameter of equal to or less than 3.50 mm to the total number N is preferably equal to or less than 0.20, more preferably equal to or less than 0.15, and particularly preferably equal to or less than 0.10. Ideally, the ratio (N4/N) is zero.

From the standpoint that sufficient occupation ratio can be achieved, total number of the dimples 8 is preferably equal to or greater than 200, and particularly preferably equal to or greater than 252. From the standpoint that individual dimples 8 can have a sufficient diameter, it is preferred that the total number is equal to or less than 362, further equal to or less than 360, still more equal to or less than 332, and yet more equal to or less than 328.

It is preferred that multiple types of the dimples 8 having a different diameter one another are arranged. By thus arranging multiple types of the dimples 8, great ratio (N1/N), great ratio (N2/N1), great mean diameter Da, and small ratio (N3/N1) of the golf ball 2 can be achieved. In this respect, number of the types of the dimples 8 is more preferably equal to or greater than 3, and particularly preferably equal to or greater than 4. In light of ease in manufacture of the mold, the number of the types is preferably equal to or less than 15.

According to the present invention, the term "dimple volume" means a volume of a part surrounded by a plane that includes the contour of the dimple 8, and the surface of the dimple 8. In light of possible suppression of hopping of the golf ball 2, total volume of the dimples 8 is preferably equal to or greater than 250 $mm^3$, more preferably equal to or greater than 260 $mm^3$, and particularly preferably equal to or greater than 270 $mm^3$. In light of possible suppression of dropping of the golf ball 2, the total volume is preferably equal to or less than 400 $mm^3$, more preferably equal to or less than 390 $mm^3$, and particularly preferably equal to or less than 380 $mm^3$.

In light of possible suppression of hopping of the golf ball 2, the depth of the dimple 8 is preferably equal to or greater than 0.05 mm, more preferably equal to or greater than 0.08 mm, and particularly preferably equal to or greater than 0.10 mm. In light of possible suppression of dropping of the golf ball 2, the depth is preferably equal to or less than 0.60 mm, more preferably equal to or less than 0.45 mm, and particularly preferably equal to or less than 0.40 mm. The depth is a distance between the tangent line T and the deepest point of the dimple 8.

In the present invention, the great circle that is situated on the phantom sphere 12 and that does not cross the dimple 8 is referred to as "great circle band". When the rotation axis of the back spin is orthogonal to a plane including the great circle band, circumferential rate of the back spin becomes greatest on this great circle band. When the rotation axis of the back spin is orthogonal to a plane including the great circle band, sufficient dimple effect may not be achieved. The great circle band interferes the flight performance. Further, the great circle band also interferes the aerodynamic symmetry. It is preferred that the golf ball 2 does not have any great circle band.

In FIG. 2, two pole points P, two first latitude lines 14, two second latitude lines 16 and an equatorial line 18 are depicted. Latitude of the pole point P is 90°, and latitude of the equatorial line 18 is 0°. Latitude of the first latitude line 14 is greater than that of the second latitude line 16.

This golf ball 2 has a northern hemisphere N above the equatorial line 18, and a southern hemisphere S below the equatorial line 18. Each of the northern hemisphere N and the southern hemisphere S has a pole vicinity region 20, an equator vicinity region 22 and a coordination region 24. The first latitude line 14 is a boundary line between the pole vicinity region 20 and the coordination region 24. The second latitude line 16 is a boundary line between the equator vicinity region 22 and the coordination region 24. The pole vicinity region 20 is located between the pole point P and the first latitude line 14. The equator vicinity region 22 is located between the second latitude line 16 and the equatorial line 18. The coordination region 24 is located between the first latitude line 14 and the second latitude line 16. In other words, the coordination region 24 is located between the pole vicinity region 20 and the equator vicinity region 22.

With respect to the dimple 8 crossing over the first latitude line 14 or the second latitude line 16, the region to which it belongs is decided on the basis of the center position thereof. The dimple 8 which crosses over the first latitude line 14 and which has the center positioned in the pole vicinity region 20 belongs to the pole vicinity region 20. The dimple 8 which crosses over the first latitude line 14 and which has the center positioned in the coordination region 24 belongs to the coordination region 24. The dimple 8 which crosses over the second latitude line 16 and which has the center positioned in the equator vicinity region 22 belongs to the equator vicinity region 22. The dimple 8 which crosses over the second latitude line 16 and which has the center positioned in the coordination region 24 belongs to the coordination region 24.

Figure 6:
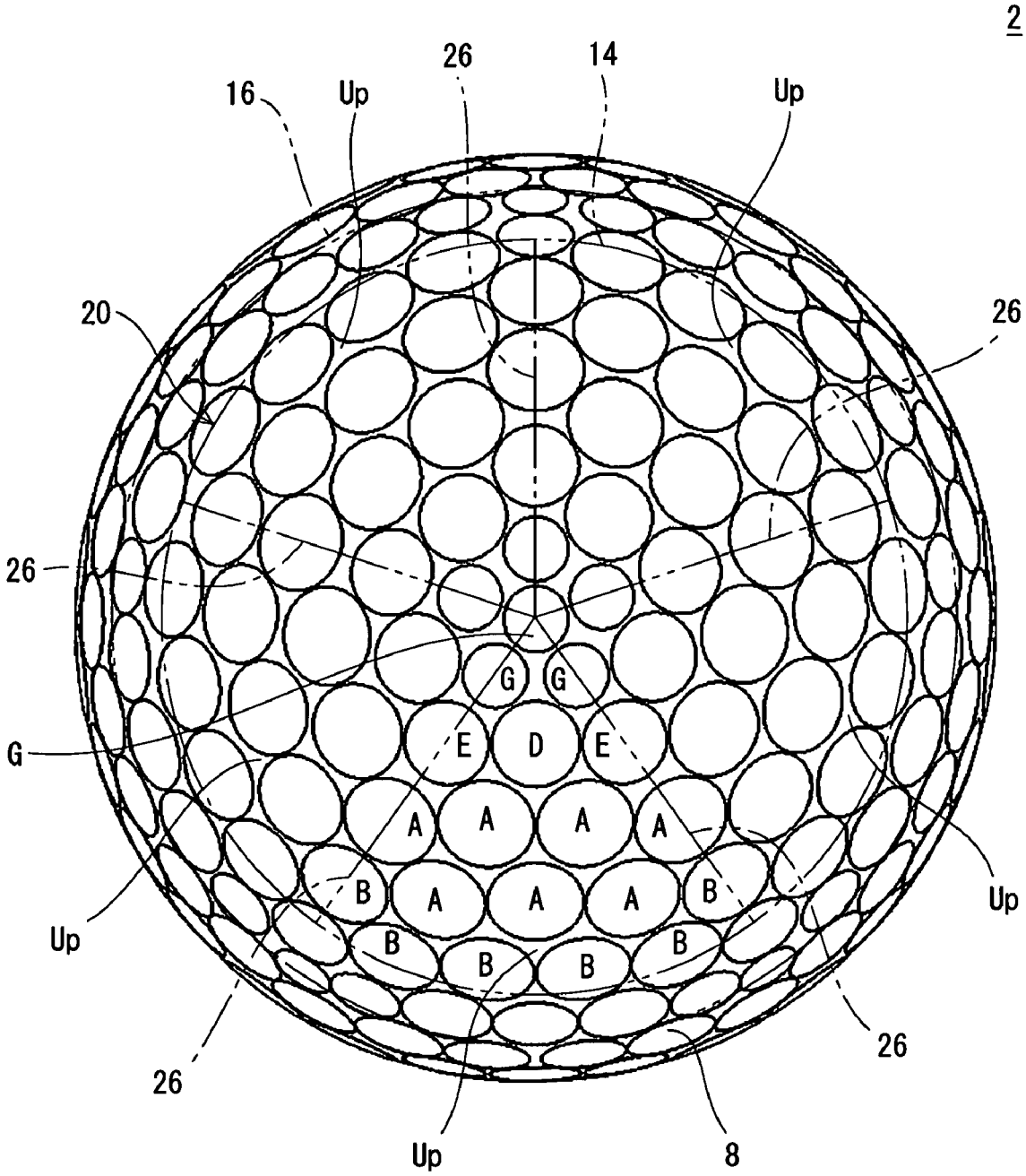
FIG. 6 shows a plan view illustrating the golf ball shown in FIG. 2.
Figure 7:
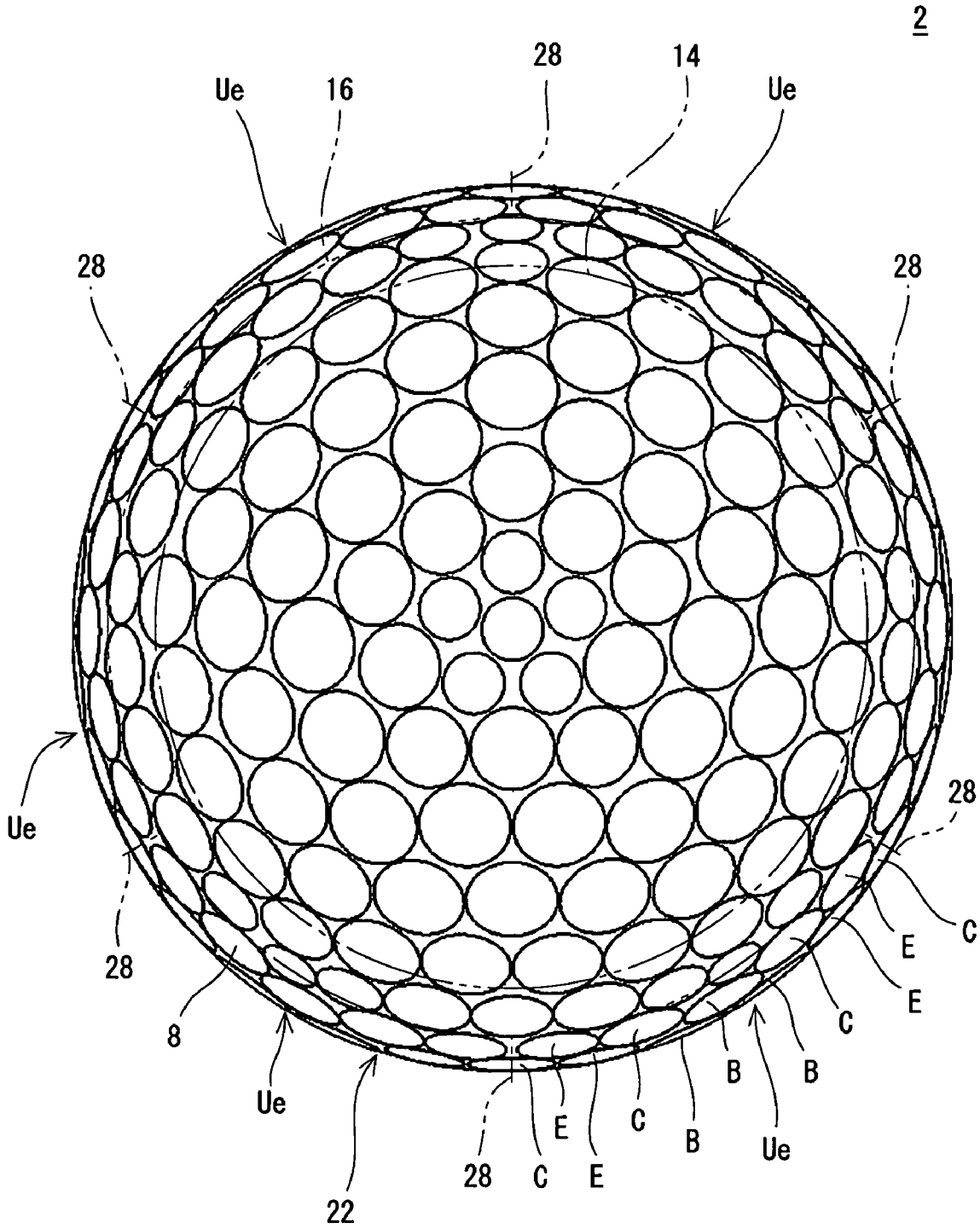
FIG. 7 shows a plan view illustrating the golf ball shown in FIG. 2.
Figure 8:
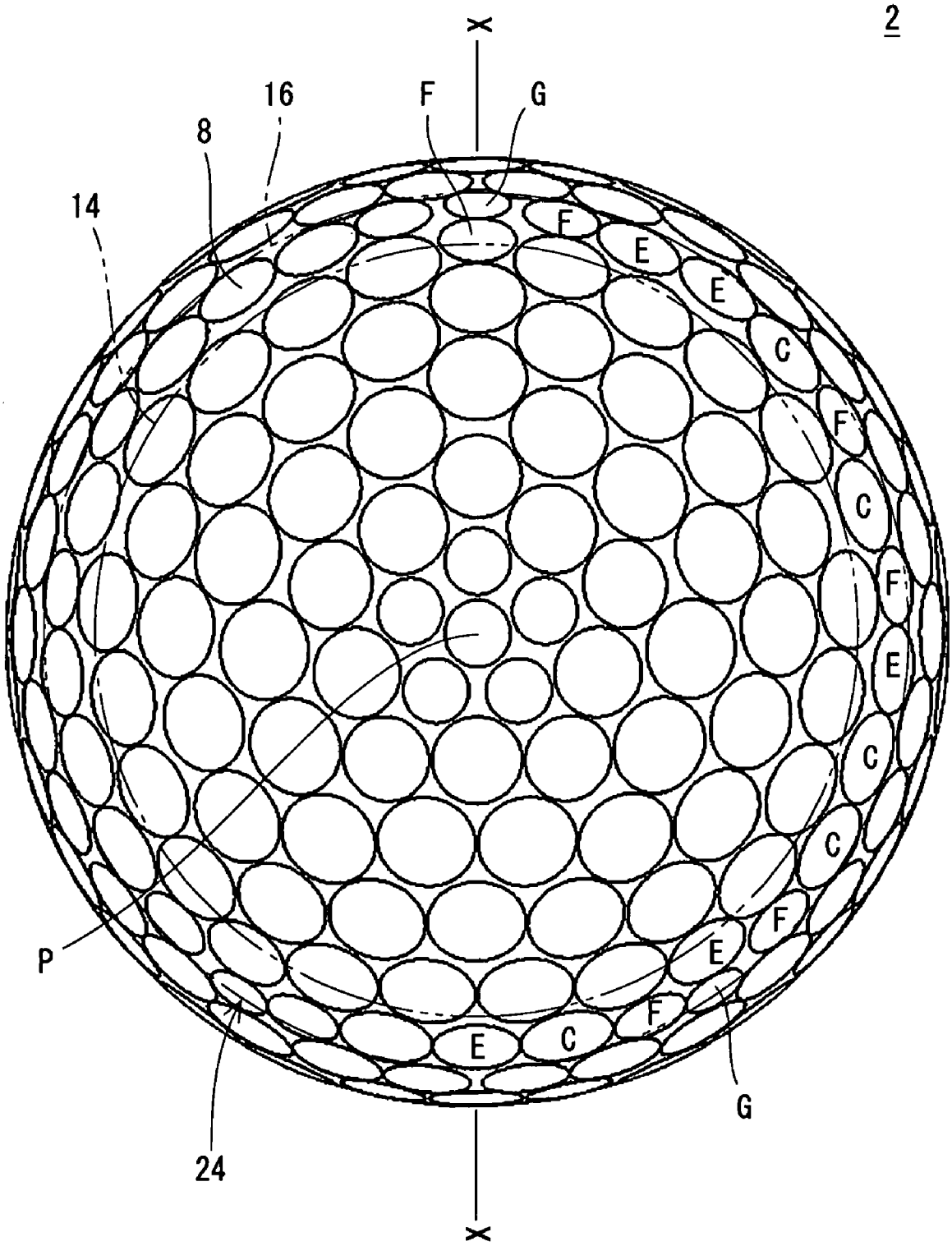
FIG. 8 shows a plan view illustrating the golf ball shown in FIG. 2.

FIGS. 6, 7 and 8 show a plan view illustrating the golf ball 2 shown in FIG. 2. FIG. 6 shows five first meridian lines 26 together with the first latitude line 14 and the second latitude line 16. In this FIG. 6, the region surrounded by the first latitude line 14 is the pole vicinity region 20. The pole vicinity region 20 can be comparted into five units Up. The unit Up has a spherical triangular shape. The contour of the unit Up consists of a part of the first latitude line 14, and two first meridian lines 26. In FIG. 6, types of the dimples 8 are shown by the reference signs A, B, D, E and G with respect to one unit Up.

The dimple pattern in five units Up has rotational symmetries through 72°. In other words, when the dimple pattern in one unit Up is rotated 72° in a meridian direction around the pole point P as a center, it substantially overlaps with the dimple pattern in the adjacent unit Up. Herein, the states of "substantially overlapping" include not only the states in which the dimple 8 in one unit completely coincides with the corresponding dimple 8 in another unit, but also the states in which the dimple 8 in one unit is deviated to some extent from the corresponding dimple 8 in another unit. Herein, the states of "deviated to some extent" include the states in which the center of the dimple 8 in one unit deviates to some extent from the center of the corresponding dimple 8 in another unit. The distance between the center of the dimple 8 in one unit and the center of the corresponding dimple 8 in another unit is preferably equal to or less than 1.0 mm, and more preferably equal to or less than 0.5 mm. Herein, the states of "deviated to some extent" include the states in which the dimension of the dimple 8 in one unit is different to some extent from the dimension of the corresponding dimple 8 in another unit. The difference in dimension is preferably equal to or less than 0.5 mm, and more preferably equal to or less than 0.3 mm. The dimension means the length of the longest line segment which can be depicted over the contour of the dimple 8. In the case of a circular dimple 8, the dimension is identical with the diameter of the same.

FIG. 7 shows six second meridian lines 28 together with the first latitude line 14 and the second latitude line 16. In this FIG. 7, the external side of the second latitude line 16 corresponds to the equator vicinity region 22. The equator vicinity region 22 can be comparted into six units Ue. The unit Ue has a spherical trapezoidal shape. The contour of the unit Ue consists of a part of the second latitude line 16, two second meridian lines 28 and a part of the equatorial line 18 (see, FIG.

2). In FIG. 7, types of the dimples 8 are shown by the reference signs B, C and E with respect to one unit Ue.

The dimple pattern in six units Ue has rotational symmetries through 60°. In other words, when the dimple pattern in one unit Ue is rotated 60° in a meridian direction around the pole point P as a center, it substantially overlaps with the dimple pattern in the adjacent unit Ue. The dimple pattern in the equator vicinity region 22 can be also comparted into three units. In this instance, the dimple pattern in each unit has rotational symmetries through 120°. The dimple pattern in the equator vicinity region 22 can be also comparted into two units. In this instance, the dimple pattern in each unit has rotational symmetries through 180°. The dimple pattern in the equator vicinity region 22 has three rotation symmetry angles (i.e., 60°, 120° and 180°). In the region having multiple rotation symmetry angles, the unit Ue is decided by the compartment on the basis of the smallest rotation symmetry angle (in this case, 60°).

FIG. 8 shows the first latitude line 14 and the second latitude line 16. In this FIG. 8, the region surrounded by the first latitude line 14 and the second latitude line 16 is the coordination region 24. In FIG. 8, with respect to the dimples 8 provided in the coordination region 24, types thereof are shown by the reference signs C, E, F and G.

The dimple pattern in the coordination region 24 has a line symmetry with respect to a line X-X in a plan view. This dimple pattern does not have any axis of symmetry other than the line X-X. Rotation of 0° or greater and less than 360° around the pole point P as a center does not generate any overlap of the dimple patterns with one another. In other words, the dimple pattern in the coordination region 24 cannot be comparted into multiple units that are rotationally symmetric each other.

The dimple pattern in the coordination region 24 which can be comparted into multiple units that are rotationally symmetric is also acceptable. In this instance, number of the units in the coordination region 24 must be different from the number of the units Up in the pole vicinity region 20, and further, must be also different from the number of the units Ue in the equator vicinity region 22.

In this golf ball 2, number Np of the units Up in the pole vicinity region 20 is 5, while number Ne of the units Ue in the equator vicinity region 22 is 6. These numbers are different from each other. The dimple pattern with the number Np and the number Ne being different from each other has great variety. According to this golf ball 2, air flow during the flight is efficiently disturbed. This golf ball 2 is excellent in the flight performance. Combination of the number Np and the number Ne (Np, Ne) is not limited to (5, 6) as described above. Illustrative examples of other combination include (2, 3), (2, 4), (2, 5), (2, 6), (3, 2), (3, 4), (3, 5), (3, 6), (4, 2), (4, 3), (4, 5), (4, 6), (5, 2), (5, 3), (5, 4), (6, 2), (6, 3), (6, 4) and (6, 5).

Although detailed grounds are unknown, greater dimple effect can be achieved when one of the number Np and the number Ne is an odd number, and another is an even number, according to findings attained by the present inventor. In addition, particularly great dimple effect can be achieved when the difference between the number Np and the number Ne is 1. Illustrative examples of the combination involving this difference of 1 include (2, 3), (3, 2), (3, 4), (4, 3), (4, 5), (5, 4), (5, 6) and (6, 5).

In light of the dimple effect, it is preferred that the pole vicinity region 20 has a sufficient area, and that the equator vicinity region 22 also has a sufficient area. In light of the area of the equator vicinity region 22, latitude of the first latitude line 14 and the second latitude line 16 is preferably equal to or greater than 15°, and more preferably equal to or greater than 20°. In light of the area of the pole vicinity region 20, latitude of the first latitude line 14 and the second latitude line 16 is preferably equal to or less than 45°, and more preferably equal to or less than 40°. The first latitude line 14 can be arbitrarily selected from among innumerable latitude lines. The second latitude line 16 can be also selected arbitrarily from among innumerable latitude lines. In the golf ball 2 shown in FIGS. 2, 6, 7 and 8, the latitude of the first latitude line 14 is 42°, and the latitude of the second latitude line 16 is 30°.

In light of contribution of the pole vicinity region 20 to the dimple effect, proportion of the number of the dimples 8 that exist in the pole vicinity region 20 to total number of the dimples 8 is preferably equal to or greater than 20%, and more preferably equal to or greater than 25%. This proportion is preferably equal to or less than 45%.

In light of contribution of the equator vicinity region 22 to the dimple effect, proportion of the number of the dimples 8 that exist in the equator vicinity region 22 to total number of the dimples 8 is preferably equal to or greater than 30%, and more preferably equal to or greater than 35%. This proportion is preferably equal to or less than 65%.

Provided that the pole vicinity region 20 is adjacent to the equator vicinity region 22 across the boundary line, the dimples 8 cannot be arranged densely in the vicinity of this boundary line resulting from the difference in the numbers of the units. In this case, large land 10 shall be present in the vicinity of the boundary line. The large land 10 inhibits the dimple effect. In the golf ball 2 according to the present invention, the coordination region 24 is present between the pole vicinity region 20 and the equator vicinity region 22. In this coordination region 24, the dimples 8 can be arranged without being bound by the number of the units. Thus, the area of the land 10 can be diminished. Owing to this coordination region 24, high occupation ratio may be achieved.

In light of the occupation ratio, it is preferred that the coordination region 24 has a sufficient area. In this respect, the difference between the latitude of the first latitude line 14 and the latitude of the second latitude line 16 is preferably equal to or greater than 4°. When the coordination region 24 is too large, the dimple effect resulting from the difference between the number Np and the number Ne may be deteriorated. In light of the dimple effect, the difference between the latitude of the first latitude line 14 and the latitude of the second latitude line 16 is preferably equal to or less than 20°, and more preferably equal to or less than 15°.

In light of the occupation ratio, proportion of the number of the dimples 8 that exist in the coordination region 24 to total number of the dimples 8 is preferably equal to or greater than 5%, and more preferably equal to or greater than 8%. In light of the dimple effect resulting from the difference between the number Np and the number Ne, this proportion is preferably equal to or less than 24%, more preferably equal to or less than 22%, and particularly preferably equal to or less than 20%.

According to the golf ball 2 in which the pole vicinity region 20 is comparted into the units Up, and further the equator vicinity region 22 is comparted into the units Ue, period of the pattern is generated by rotation. As the number Np of the units Up and the number Ne of the units Ue are larger, the period becomes shorter. To the contrary, as the number Np and the number Ne are smaller, the period becomes longer. Adequate period may improve the dimple effect. In light of the adequate period, the number Np and the number Ne are preferably 4 or greater and 6 or less, and particularly preferably 5 or greater and 6 or less. Most preferable combination of the number Np and the number Ne (NP, Ne) is (5, 6) and (6, 5). In the golf ball 2 shown in FIG. 2 and FIGS. 6 to 8, (Np, Ne) is (5, 6).

In light of the aerodynamic symmetry, it is preferred that the dimple pattern in the northern hemisphere N is equivalent to the dimple pattern in the southern hemisphere S. When a pattern that is symmetric to the dimple pattern in the northern hemisphere N with respect to the plane that includes the equatorial line 18 substantially overlaps with the dimple pattern in the southern hemisphere S, these patterns are decided to be equivalent. Also, when the pattern that is symmetric to the dimple pattern in the northern hemisphere N with respect to the plane that includes the equatorial line 18 substantially overlaps with the dimple pattern in the southern hemisphere S upon rotation thereof around the pole point P as a center, these patterns are decided to be equivalent.

According to the present invention, size of each site of the dimple 8 is measured on the golf ball 2 having a paint layer.

Figure 9:
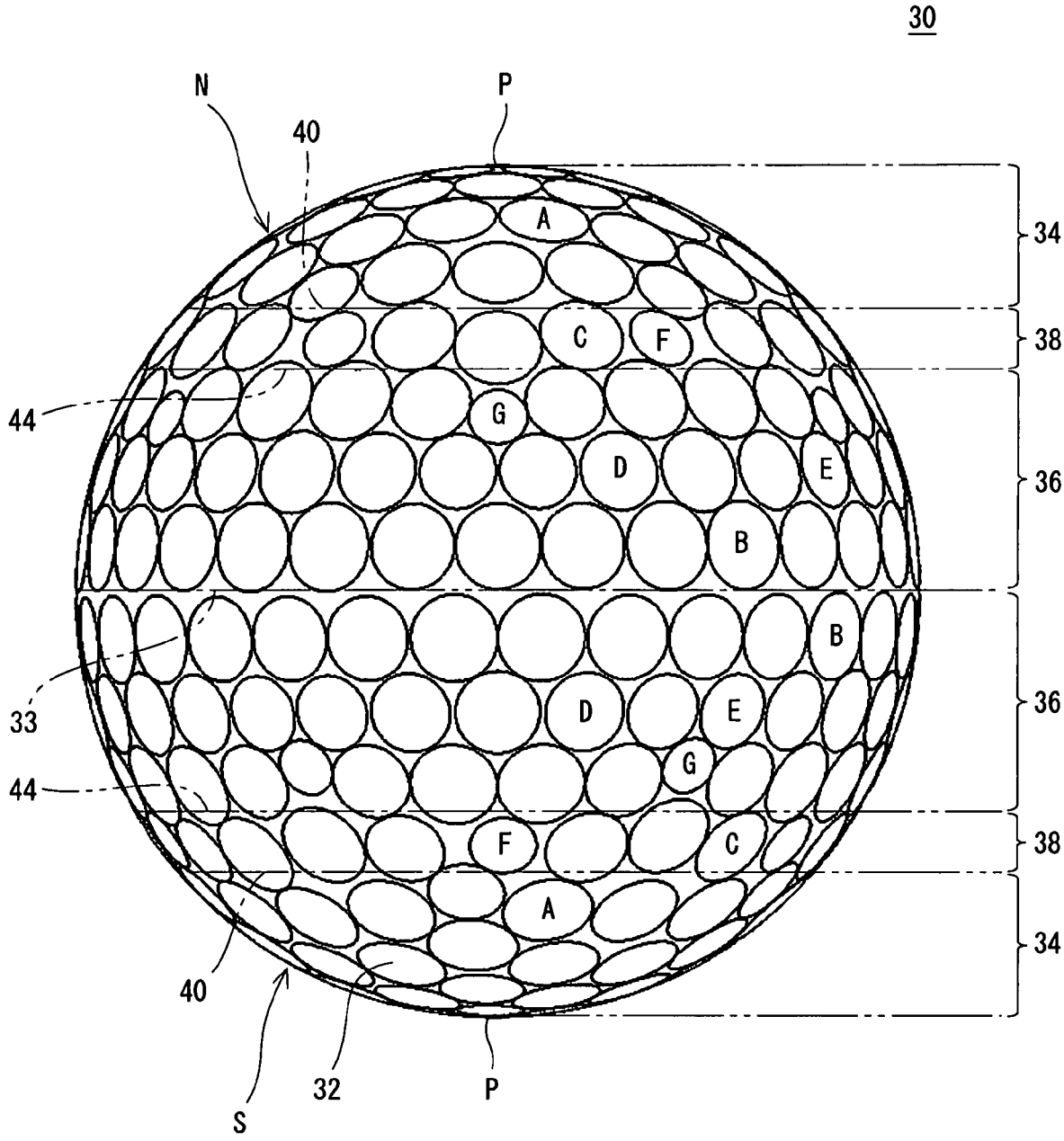
FIG. 9 shows a front view illustrating a golf ball according to another embodiment of the present invention.

FIG. 9 shows a front view illustrating a golf ball 30 according to another embodiment of the present invention. In FIG. 9, types of the dimples 32 are indicated by the reference signs A to G. All dimples 32 have a plane shape of circular. This golf ball 30 has dimples A having a diameter of 4.60 mm, dimples B having a diameter of 4.45 mm, dimples C having a diameter of 4.30 mm, dimples D having a diameter of 4.10 mm, dimples E having a diameter of 3.90 mm, dimples F having a diameter of 3.40 mm, and dimples G having a diameter of 3.00 mm. Number of the dimples A is 80; number of the dimples B is 60; number of the dimples C is 62; number of the dimples D is 58; number of the dimples E is 38; number of the dimples F is 18; and number of the dimples G is 14. Total number of the dimples 32 is 330.

This golf ball 30 has 1476 adjacent dimple pairs. Among them, 964 adjacent dimple pairs have a pitch of equal to or less than (Da/4), and 614 adjacent dimple pairs have a pitch of equal to or less than (Da/20). The ratio (N1/N) of the number N1 of the adjacent dimple pairs having a pitch of (Da/4) or less to the total number N of the dimples is 2.92. The ratio (N2/N1) of the number N2 of the adjacent dimple pairs having a pitch of (Da/20) or less to the number N1 is 0.64. In the golf ball 30, the dimples 32 are arranged in an extremely dense manner, and the number of small dimples 32 is low. In this golf ball 30, individual dimples 32 can be responsible for the dimple effect. This golf ball 30 is excellent in the flight performance.

This golf ball 30 has a mean diameter Da of 4.21 mm, and an occupation ratio of 81.1%. This golf ball 30 has seven types of the dimples 32. According to this golf ball 30, the number N3 of the crossing adjacent dimple pairs is 58, and the ratio (N3/N1) is 0.060. According to this golf ball 30, the ratio (N4/N) of the number N4 of the dimples 32 having a diameter of equal to or less than 3.50 mm to the total number N is 0.10. According to this golf ball 30, great ratio (N1/N), great ratio (N2/N1), great mean diameter Da, small ratio (N3/N1), and small ratio (N4/N) are achieved. This golf ball 30 is excellent in the flight performance.

As shown in FIG. 9, this golf ball 30 has an equatorial line 33, a northern hemisphere N and a southern hemisphere S. The equatorial line 33 is a great circle band. Each of the northern hemisphere N and the southern hemisphere S has a pole vicinity region 34, an equator vicinity region 36 and a coordination region 38.

Figure 10:
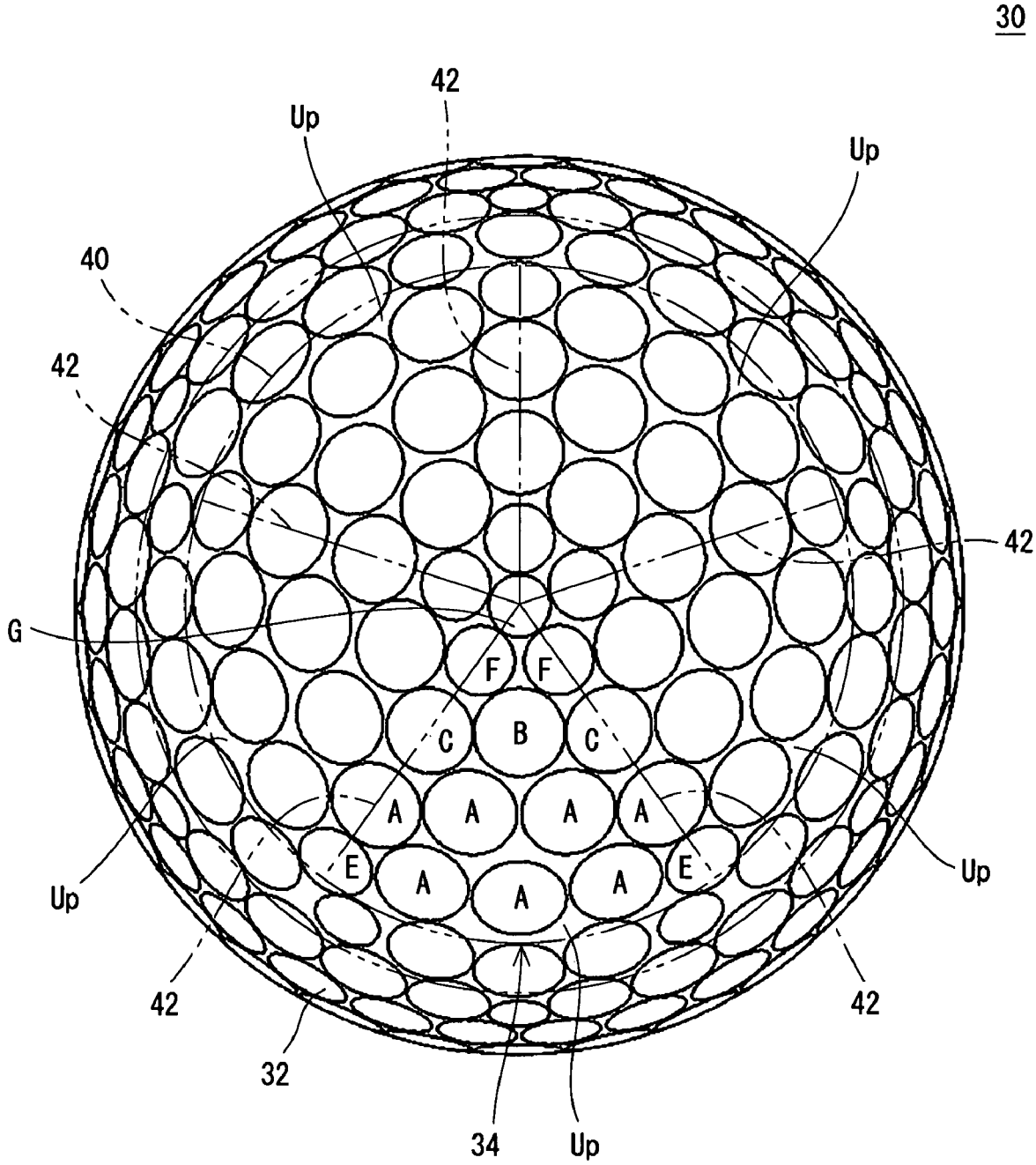
FIG. 10 shows a plan view illustrating the golf ball shown in FIG. 9.
Figure 11:
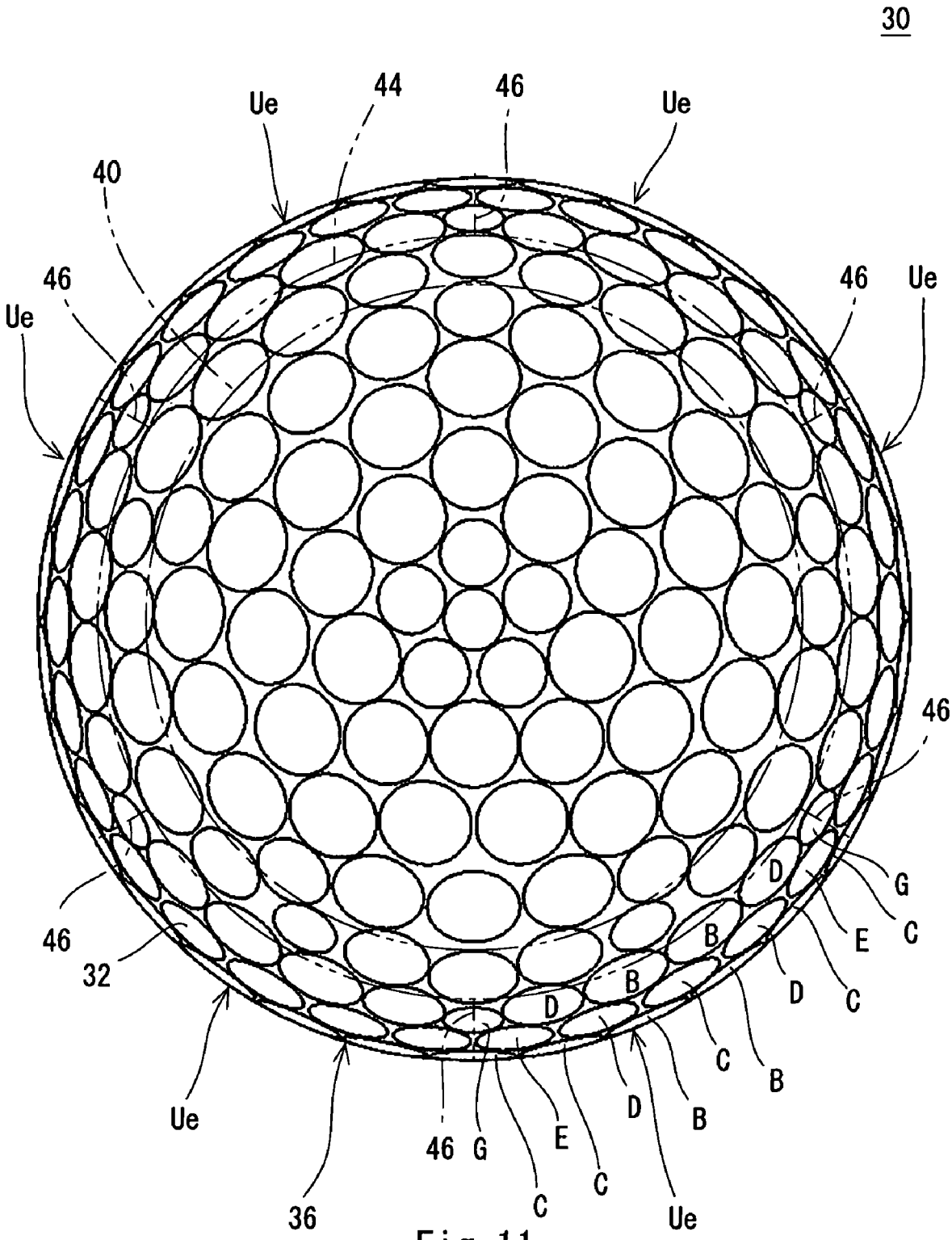
FIG. 11 shows a plan view illustrating the golf ball shown in FIG. 9.
Figure 12:
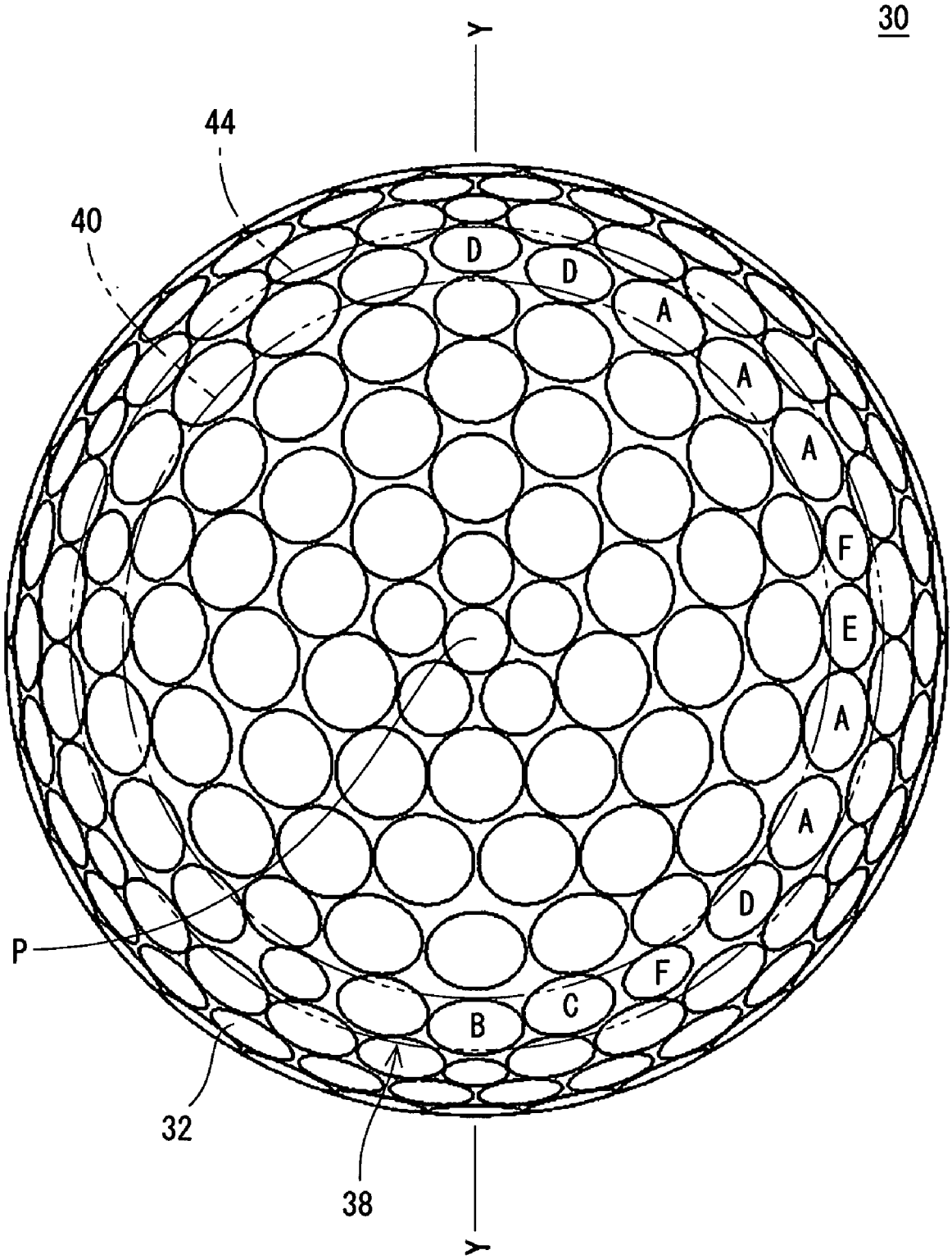
FIG. 12 shows a plan view illustrating the golf ball shown in FIG. 9.

FIGS. 10, 11 and 12 show a plan view illustrating the golf ball 30 shown in FIG. 9. In FIG. 10, the region surrounded by the first latitude line 40 is a pole vicinity region 34. The pole vicinity region 34 can be comparted into five units Up. The unit Up has a spherical triangular shape. The contour of the unit Up consists of a part of the first latitude line 40, and two first meridian lines 42. In FIG. 10, types of the dimples 32 are shown by the reference signs A, B, C, E and G with respect to one unit Up. The dimple pattern in five units Up has rotational symmetries through 72°.

In FIG. 11, the external side of the second latitude line 44 corresponds to the equator vicinity region 36. The equator vicinity region 36 can be comparted into six units Ue. The unit Ue has a spherical trapezoidal shape. The contour of the unit Ue consists of a part of the second latitude line 44, two second meridian lines 46 and a part of the equatorial line 33 (see, FIG. 9). In FIG. 11, types of the dimples 32 are shown by the reference signs B, C, D, E and G with respect to one unit Ue. The dimple pattern in six units Ue has rotational symmetries through 60°.

In FIG. 12, the region surrounded by the first latitude line 40 and the second latitude line 44 is the coordination region 38. In FIG. 12, with respect to the dimples 32 provided in the coordination region 38, types thereof are shown by the reference signs A, B, C, D, E and F. The dimple pattern in the coordination region 38 has a line symmetry with respect to a line Y-Y in a plan view. This dimple pattern does not have any axis of symmetry other than the line Y-Y. Rotation of 0° or greater and less than 360° around the pole point P as a center does not generate overlap of the dimple patterns with one another. In other words, the dimple pattern in the coordination region 38 cannot be comparted into multiple units that are rotationally symmetric each other.

In the golf ball 30 shown in FIGS. 9 to 12, the latitude of the first latitude line 40 is 35°, and the latitude of the second latitude line 44 is 210°.

In this golf ball 30, the number Np of the units Up in the pole vicinity region 34 is 5, while the number Ne of the units Ue in the equator vicinity region 36 is 6. This dimple pattern has great variety. According to this golf ball 30, the coordination region 38 is responsible for a great occupation ratio. This golf ball 30 is excellent in the flight performance.

Figure 13:
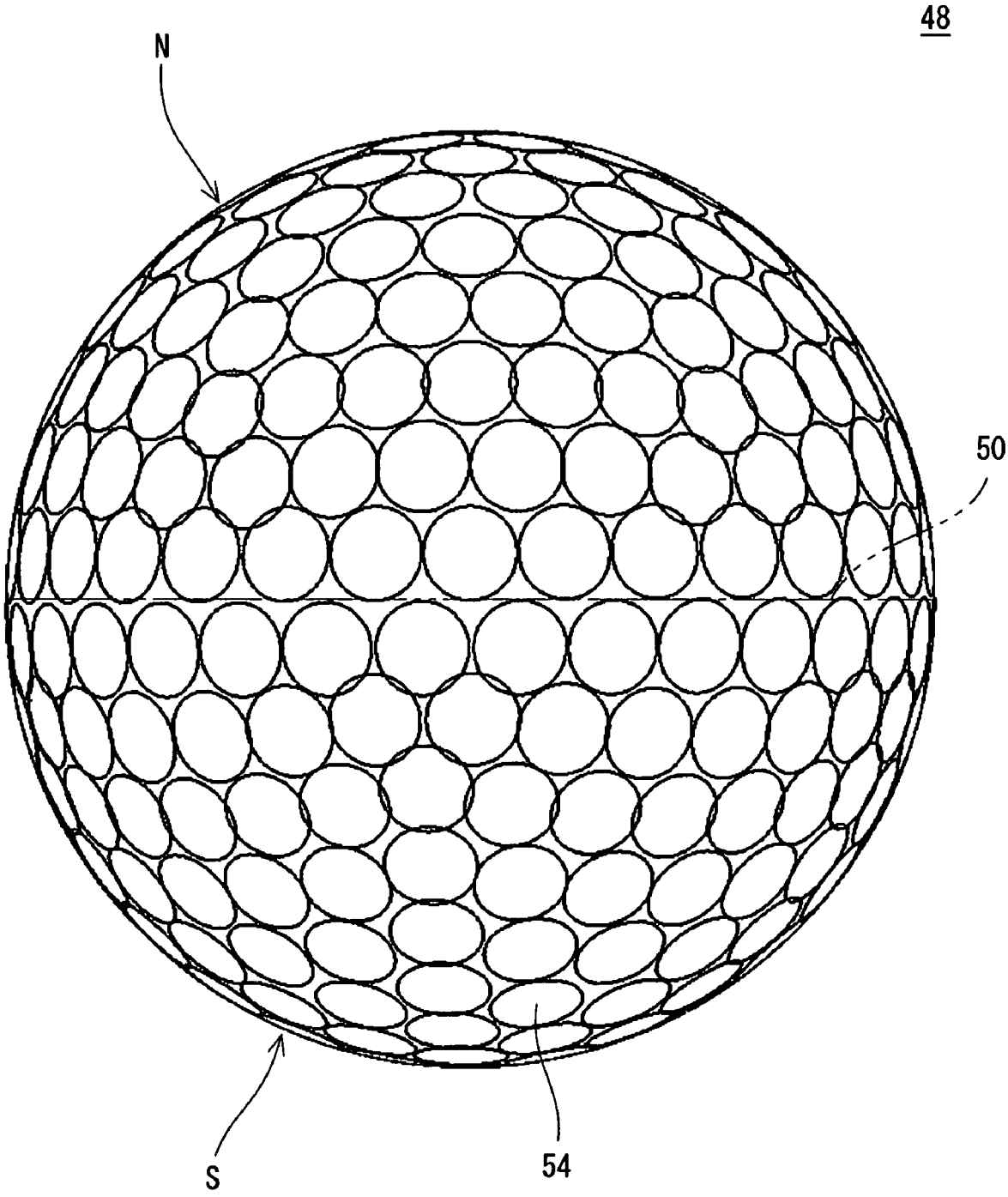
FIG. 13 shows a front view illustrating a golf ball according to still another embodiment of the present invention.
Figure 14:
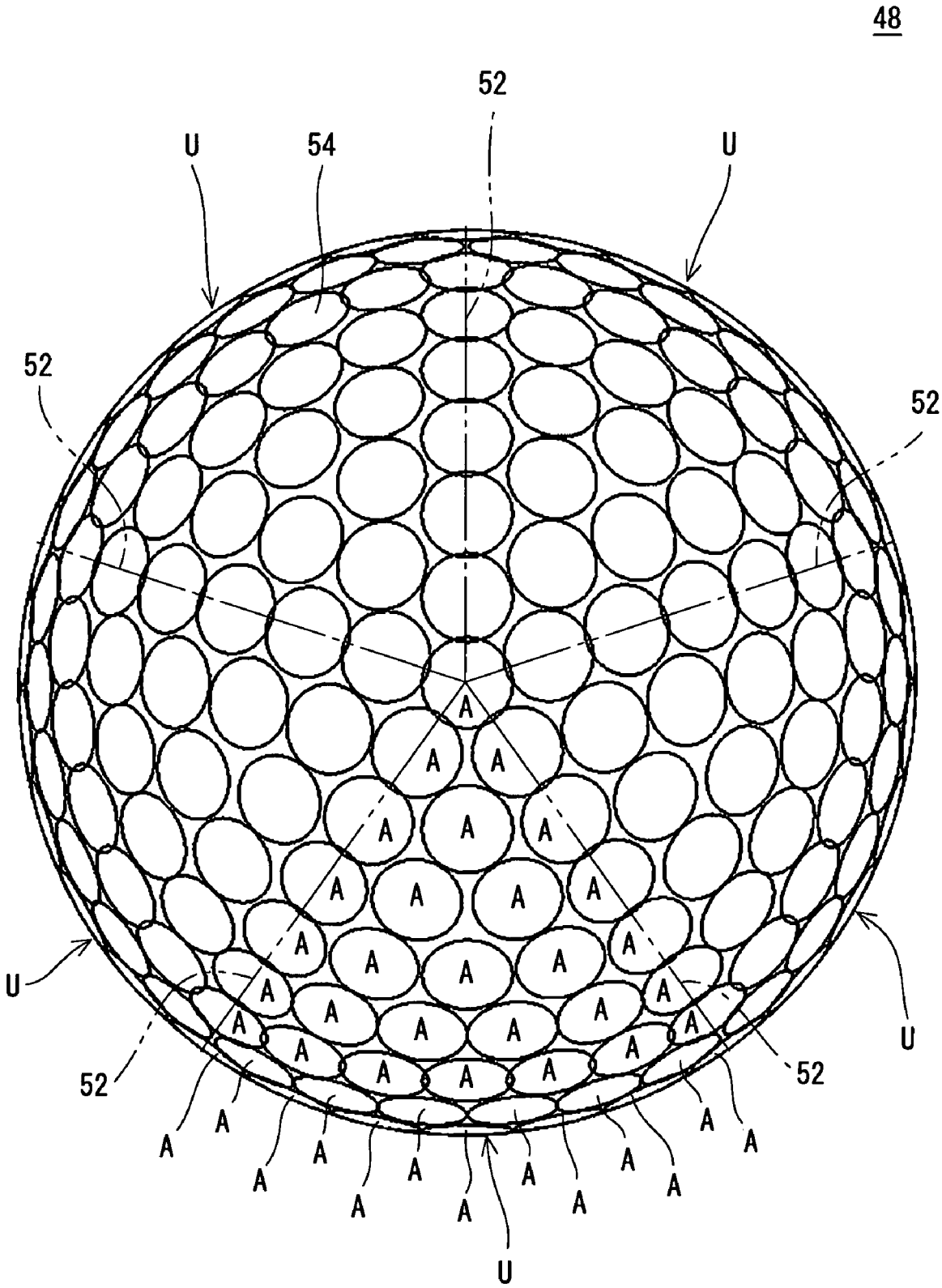
FIG. 14 shows a plan view illustrating the golf ball shown in FIG. 13.

FIG. 13 shows a front view illustrating a golf ball 48 according to still another embodiment of the present invention, and FIG. 14 shows a plan view of the same. As shown in FIG. 13, this golf ball 48 has an equatorial line 50, a northern hemisphere N and a southern hemisphere S. As shown in FIG. 14, each of the northern hemisphere N and the southern hemisphere S can be comparted into 5 units U. The unit U has a spherical triangular shape. The contour of the unit U consists of two meridian lines 52, and a part of the equatorial line 50 (see, FIG. 13). In FIG. 14, types of the dimples 54 are shown by the reference sign A with respect to one unit U. The dimple A has a diameter of 4.318 mm. Total number N of the dimples 54 is 332. The dimple pattern in five units U has rotational symmetries through 72°.

This golf ball 48 has 1450 adjacent dimple pairs. Among them, 990 adjacent dimple pairs have a pitch of equal to or less than (Da/4), and 540 adjacent dimple pairs have a pitch of equal to or less than (Da/20). The ratio (N1/N) of the number N1 of the adjacent dimple pairs having a pitch of (Da/4) or less to the total number N of the dimples is 2.98. The ratio (N2/N1) of the number N2 of the adjacent dimple pairs having a pitch of (Da/20) or less to the number N1 is 0.55. In the golf ball 48, the dimples 54 are arranged in an extremely dense manner, and the number of small dimples 54 is low. In this golf ball 48, individual dimples 54 can be responsible for the dimple effect. This golf ball 48 is excellent in the flight performance.

This golf ball 48 has a mean diameter Da of 4.318 mm, and an occupation ratio of 84.9%. According to this golf ball 48, the ratio (N4/N) of the number N4 of the dimples 54 having a diameter of equal to or less than 3.50 mm to the total number N is zero. According to this golf ball 48, great ratio (N1/N), great ratio (N2/N1), great mean diameter Da, and small ratio (N4/N) are achieved.

According to this golf ball 48, the number N3 of the crossing adjacent dimple pairs is 260, and the ratio (N3/N1) is 0.263. This ratio (N3/N1) is great. According to this golf ball 48, the effective area is small as compared with the apparent occupation ratio. Small effective area is disadvantageous in light of the dimple effect. As is clear from FIG. 13, the equatorial line 50 does not cross the dimple 54. This equatorial line 54 corresponds to the great circle band. This golf ball 48 has one great circle band. The presence of the great circle band is disadvantageous in light of the dimple effect.

EXAMPLES

Example 1

A rubber composition was obtained by kneading 100 parts by weight of polybutadiene (trade name "BR-730", available from JSR Corporation), 30 parts by weight of zinc diacrylate, 6 parts of zinc oxide, 10 parts by weight of barium sulfate, 0.5 part by weight of diphenyl disulfide and 0.5 part by weight of dicumyl peroxide. This rubber composition was placed into a mold having upper and lower mold half each having a hemispherical cavity, and heated at 170° C. for 18 minutes to obtain a core having a diameter of 39.7 mm. On the other hand, 50 parts by weight of an ionomer resin (available from Du Pont-MITSUI POLYCHEMICALS Co., Ltd.; trade name "Himilan 1605"), 50 parts by weight of other ionomer resin (available from Du Pont-MITSUI POLYCHEMICALS Co., Ltd.; trade name "Himilan 1706") and 3 parts by weight of titanium dioxide were kneaded to obtain a resin composition. The aforementioned core was placed into a final mold having numerous pimples on the inside face, followed by injection of the aforementioned resin composition around the spherical body by injection molding to form a cover having a thickness of 1.5 mm. Numerous dimples having a shape inverted from the shape of the pimple were formed on the cover. A clear paint including a two-part liquid curable polyurethane as a base was applied on this cover to give a golf ball of Example 1 having a diameter of 42.7 mm and a weight of about 45.4 g. This golf ball had a PGA compression of about 85. This golf ball has a dimple pattern shown in FIGS. 2 and 6 to 8. Details of specifications of the dimples are presented in Tables 1 and 2 below.

Examples 2 to 4 and Comparative Examples 1 to 2

Golf balls of Examples 2 to 4 and Comparative Examples 1 to 2 were obtained in a similar manner to Example 1 except that the dimples were formed by changing the final mold so that their specifications were as shown in Tables 1 and 2 below.

Figure 15:
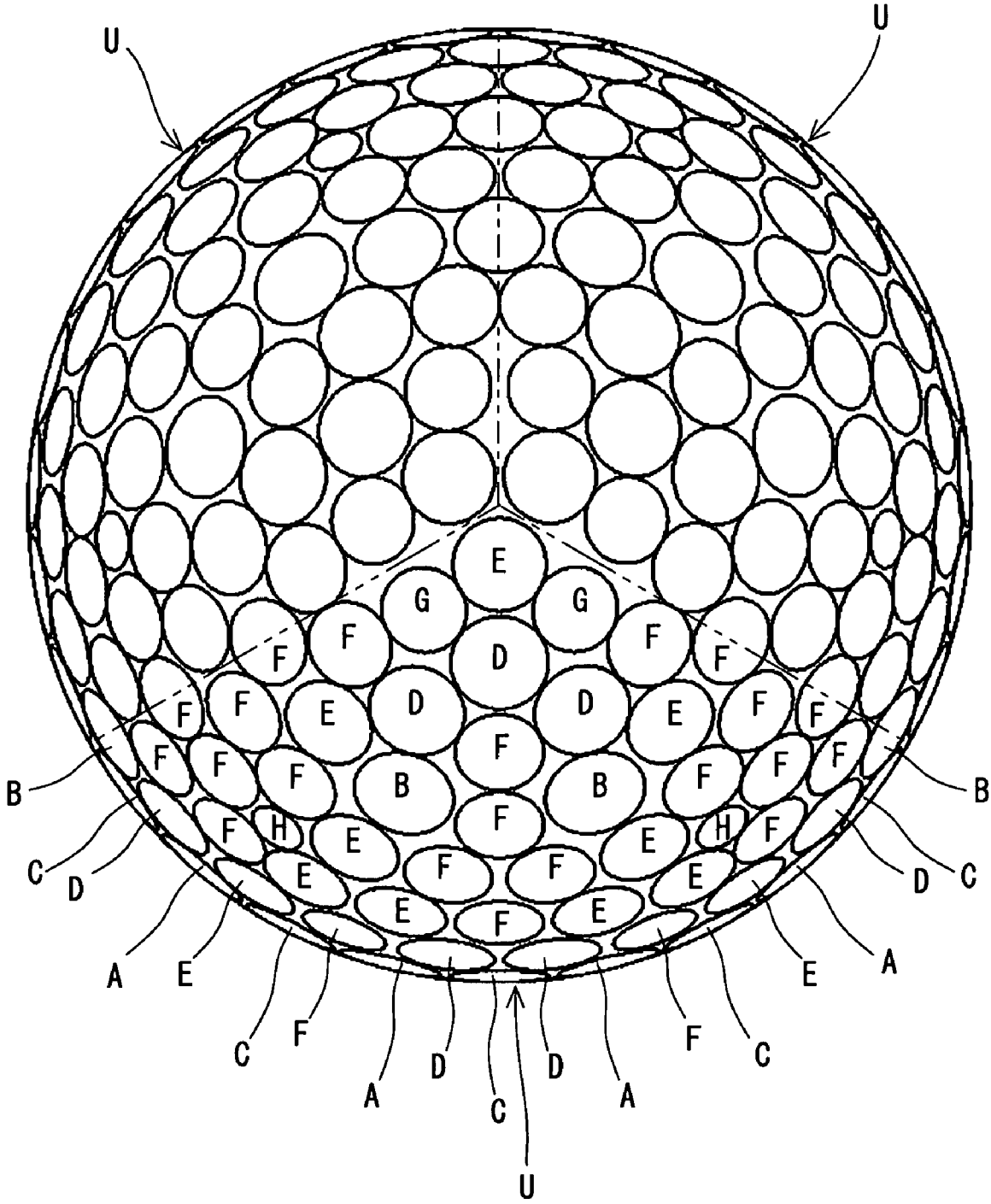
FIG. 15 shows a plan view illustrating a golf ball according to Comparative Example 1.

The golf ball of Comparative Example 1 is shown in FIG. 15. The northern hemisphere and the southern hemisphere of this golf ball have units U having rotational symmetries through 120°. In each of the northern hemisphere and the southern hemisphere, number of the units U is 3. In FIG. 15, types of the dimples are shown by the reference signs from A to H with respect to one unit.

Figure 16:
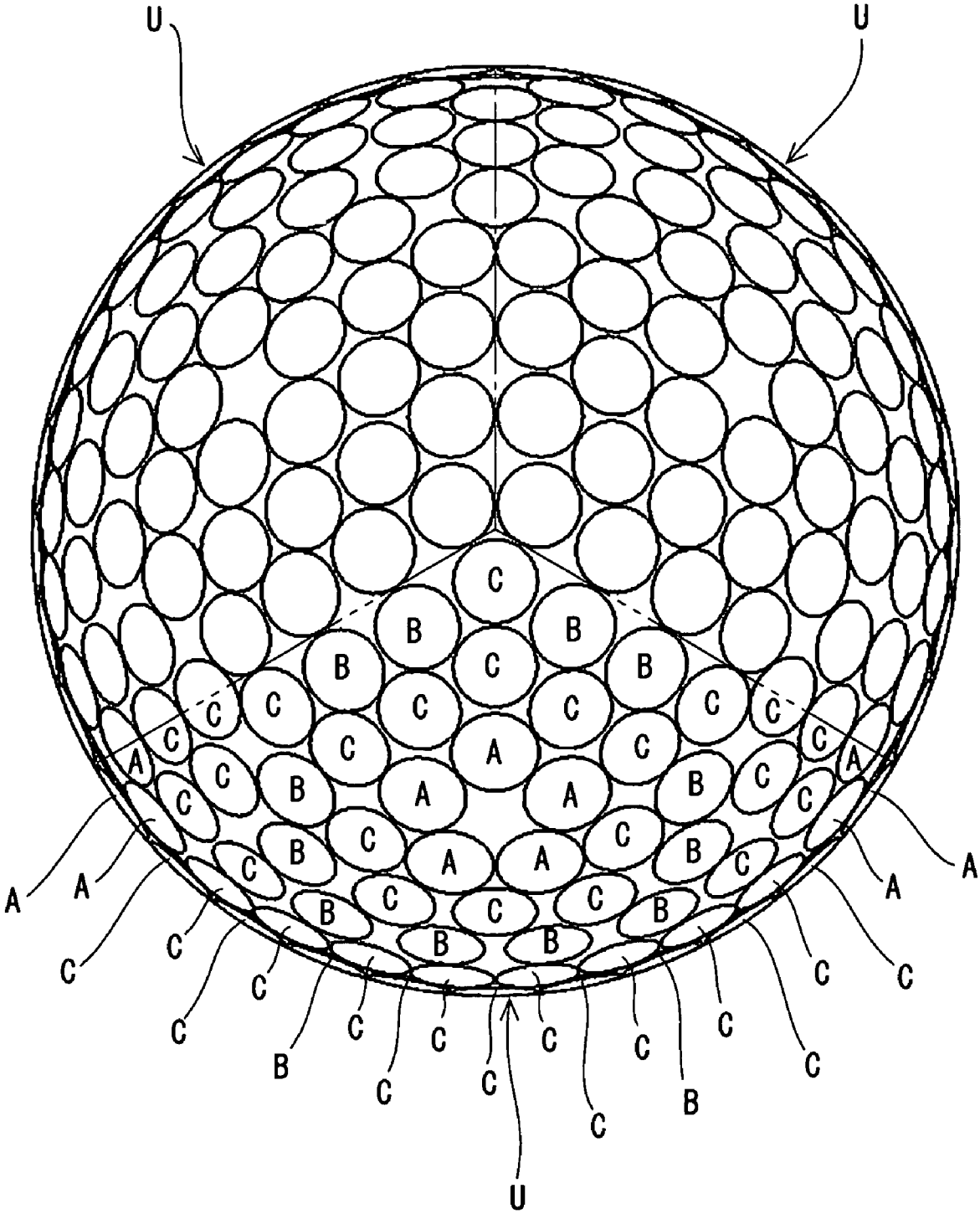
FIG. 16 shows a plan view illustrating a golf ball according to Comparative Example 2.

The golf ball of Comparative Example 2 is shown in FIG. 16. Northern hemisphere and southern hemisphere of this golf ball have units U having rotational symmetries through 120°. In each of the northern hemisphere and the southern hemisphere, number of the units U is 3. In FIG. 16, types of the dimples are shown by the reference signs from A to C with respect to one unit.

TABLE 1

Specifications of Dimples

| | | Number | Diameter Di (mm) | Depth (mm) | Curvature radius (mm) | Volume ($mm^3$) | Total volume ($mm^3$) |
|---|---|---|---|---|---|---|---|
| Example 1 | A | 60 | 4.500 | 0.1410 | 18.02 | 1.123 | 316.0 |
| | B | 86 | 4.400 | 0.1400 | 17.36 | 1.066 | |
| | C | 56 | 4.300 | 0.1400 | 16.58 | 1.018 | |
| | D | 10 | 4.100 | 0.1400 | 15.08 | 0.926 | |
| | E | 76 | 4.000 | 0.1400 | 14.36 | 0.881 | |
| | F | 22 | 3.500 | 0.1400 | 11.01 | 0.675 | |
| | G | 18 | 3.000 | 0.1400 | 8.11 | 0.496 | |
| Example 2 | A | 80 | 4.600 | 0.1360 | 19.52 | 1.131 | 315.9 |
| | B | 60 | 4.450 | 0.1360 | 18.27 | 1.059 | |
| | C | 62 | 4.300 | 0.1360 | 17.06 | 0.989 | |
| | D | 58 | 4.100 | 0.1360 | 15.52 | 0.899 | |
| | E | 38 | 3.900 | 0.1350 | 14.15 | 0.808 | |
| | F | 18 | 3.400 | 0.1350 | 10.77 | 0.614 | |
| | G | 14 | 3.000 | 0.1350 | 8.40 | 0.478 | |
| Example 3 | A | 80 | 4.555 | 0.1390 | 18.73 | 1.134 | 316.2 |
| | B | 60 | 4.405 | 0.1390 | 17.52 | 1.061 | |
| | C | 62 | 4.255 | 0.1390 | 16.35 | 0.990 | |
| | D | 58 | 4.055 | 0.1390 | 14.86 | 0.899 | |
| | E | 38 | 3.855 | 0.1380 | 13.53 | 0.807 | |
| | F | 18 | 3.355 | 0.1380 | 10.26 | 0.611 | |
| | G | 14 | 2.955 | 0.1380 | 7.98 | 0.475 | |
| Example 4 | A | 332 | 4.318 | 0.1300 | 17.99 | 0.953 | 316.4 |
| Comparative Example 1 | A | 24 | 4.700 | 0.1400 | 19.79 | 1.216 | 316.1 |
| | B | 18 | 4.600 | 0.1400 | 18.96 | 1.165 | |
| | C | 30 | 4.500 | 0.1390 | 18.28 | 1.107 | |
| | D | 42 | 4.400 | 0.1390 | 17.48 | 1.058 | |
| | E | 66 | 4.200 | 0.1390 | 15.93 | 0.964 | |
| | F | 126 | 4.000 | 0.1390 | 14.46 | 0.875 | |
| | G | 12 | 3.900 | 0.1390 | 13.75 | 0.832 | |
| | H | 12 | 2.600 | 0.1390 | 6.15 | 0.370 | |
| Comparative Example 2 | A | 60 | 4.100 | 0.1450 | 14.56 | 0.959 | 315.9 |
| | B | 84 | 4.000 | 0.1440 | 13.96 | 0.906 | |
| | C | 216 | 3.900 | 0.1410 | 13.55 | 0.844 | |

Travel Distance Test

A driver with a titanium head (trade name "XXIO", available from SRI Sports Limited, shaft hardness: X, loft angle: 9°) was attached to a swing machine, available from True Temper Co. Then the golf ball was hit under the condition to provide a head speed of 49 m/sec, a launch angle being about 11° and give the backspin rate of about 3000 rpm. Accordingly, the distance from the launching point to the point where the ball stopped was measured. Under the condition during the test, it was almost windless. Mean values of 20 times measurement are presented in Table 2 below.

TABLE 2

Results of Evaluation

| | Example 1 | Example 2 | Example 3 | Example 4 | Comparative Example 1 | Comparative Example 2 |
|---|---|---|---|---|---|---|
| Dimple pattern | FIGS. 2, 6-8 | FIGS. 9-12 | FIGS. 9-12 | FIGS. 13-14 | FIG. 15 | FIG. 16 |
| Total number N | 328 | 330 | 330 | 332 | 330 | 360 |
| Mean diameter Da (mm) | 4.16 | 4.21 | 4.17 | 4.32 | 4.17 | 3.96 |
| Number of adjacent dimple pairs | 1382 | 1476 | 1492 | 1450 | 1410 | 1410 |
| Occupation ratio (%) | 78.6 | 81.1 | 79.4 | 84.9 | 79.2 | 77.3 |

TABLE 2-continued

Results of Evaluation

| | | Example 1 | Example 2 | Example 3 | Example 4 | Comparative Example 1 | Comparative Example 2 |
|---|---|---|---|---|---|---|---|
| Number of great circle band | | 0 | 1 | 1 | 1 | 1 | 1 |
| Number N1 | | 914 | 964 | 960 | 990 | 960 | 954 |
| Ratio (N1/N) | | 2.79 | 2.92 | 2.91 | 2.98 | 2.91 | 2.65 |
| Number N2 | | 546 | 614 | 514 | 540 | 462 | 600 |
| Ratio (N2/N1) | | 0.60 | 0.64 | 0.54 | 0.55 | 0.48 | 0.63 |
| Number N3 | | 12 | 58 | 0 | 260 | 42 | 24 |
| Ratio (N3/N1) | | 0.013 | 0.060 | 0 | 0.263 | 0.044 | 0.025 |
| Pole vicinity region | Rotation symmetry angle | 72 deg. | 72 deg. | 72 deg. | — | — | — |
| | Number of units Np | 5 | 5 | 5 | — | — | — |
| Coordination region | | Line symmetry | Line symmetry | Line symmetry | — | — | — |
| Equator vicinity region | Rotation symmetry angle | 60 deg. | 60 deg. | 60 deg. | — | — | — |
| | Number of units Ne | 6 | 6 | 6 | — | — | — |
| Northern and southern hemispheres | Rotation symmetry angle | — | — | — | 72 deg. | 120 deg. | 120 deg. |
| | Number of units | — | — | — | 5 | 3 | 3 |
| Travel distance (m) | | 244.4 | 245.5 | 243.6 | 242.4 | 240.9 | 238.4 |

As shown in Table 2, the golf balls of Examples are excellent in the flight performance. Therefore, advantages of the present invention are clearly suggested by these results of evaluation.

The dimple pattern according to the present invention can be applied to not only two-piece golf balls, but also one-piece golf balls, multi-piece golf balls and wound golf balls. The foregoing description is just for illustrative examples, and various modifications can be made in the scope without departing from the principles of the present invention.

What is claimed is:

1. A golf ball having numerous dimples on the surface thereof, wherein provided that a mean diameter of all the dimples is Da, a ratio (N1/N) of a number N1 of adjacent dimple pairs having a pitch of (Da/4) or less to total number N of the dimples is equal to or greater than 2.70, a ratio (N2/N1) of a number N2 of the adjacent dimple pairs having a pitch of (Da/20) or less to the number N1 is equal to or greater than 0.50, and a ratio (N3/N1) of a number N3 of crossing adjacent dimple pairs to the number N1 is equal to or less than 0.06.

2. The golf ball according to claim 1 wherein the ratio (N2N1) is equal to or greater than 0.60.

3. The golf ball according to claim 1 wherein the mean diameter Da is equal to or greater than 4.00 mm, the total number N of the dimples is equal to or less than 362, and a proportion of the total area of all the dimples to surface area of a phantom sphere of the golf ball is equal to or greater than 75%.

4. The golf ball according to claim 1 wherein a northern hemisphere and a southern hemisphere of the surface of the golf ball have a pole vicinity region, an equator vicinity region, and a coordination region located between the pole vicinity region and the equator vicinity region, respectively, the dimple pattern in the pole vicinity region includes multiple units that are rotationally symmetric with each other centered on the pole point, the dimple pattern in the equator vicinity region includes multiple units that are rotationally symmetric with each other centered on the pole point, the number of the units in the pole vicinity region is different from number of the units in the equator vicinity region, and the dimple pattern in the coordination region is either a pattern which cannot be comparted into multiple units that are rotationally symmetric with each other centered on the pole point, or a pattern including multiple units that are rotationally symmetric with each other centered on the pole point with the number of the units being different from the number of the units in the pole vicinity region and the number of the units in the equator vicinity region.

5. The golf ball according to claim 1 wherein any great circle that does not cross the dimple is not present on the surface of the golf ball.

6. The golf ball according to claim 2 wherein the mean diameter Da is equal to or greater than 4.00 mm, the total number N of the dimples is equal to or less than 362, and a proportion of the total area of all the dimples to surface area of a phantom sphere of the golf ball is equal to or greater than 75%.

7. The golf ball according to claim 1 wherein the ratio (N1/N) is equal to or greater than 2.90 and equal to or less than 4.00.

8. The golf ball according to claim 1 wherein the ratio (N2/N1) is equal to or greater than 0.60 and is equal to or less than 1.00.

9. The golf ball according to claim 7 wherein the ratio (N2/N1) is equal to or greater than 0.60 and is equal to or less than 1.00.

10. The golf ball according to claim 3 wherein the ratio (N1/N) is equal to or greater than 2.90 and equal to or less than 4.00.

11. The golf ball according to claim 10 wherein the ratio (N2/N1) is equal to or greater than 0.60 and is equal to or less than 1.00.

12. The golf ball according to claim 1 wherein the mean diameter Da is equal to or greater than 4.10 mm and equal to or less than 5.50 mm, the total number N of the dimples is equal to or greater than 252 and equal to less than 332, and a proportion of the total area of all the dimples to surface area of a phantom sphere of the golf ball is equal to or greater than 78% and equal to or less than 90%.

* * * * *